US006691435B1

(12) United States Patent
Schultz et al.

(10) Patent No.: US 6,691,435 B1
(45) Date of Patent: Feb. 17, 2004

(54) PLOW SYSTEM INCLUDING A HYDRAULIC FLUID DIVERTER

(75) Inventors: Lynn W. Schultz, Kewaskum, WI (US); Joseph J. Graser, Muskego, WI (US); Terry C. Wendorff, Cedarburg, WI (US)

(73) Assignee: Sno-Way International, Inc., Hartford, WI (US)

( * ) Notice: Subject to any disclaimer, the term of this patent is extended or adjusted under 35 U.S.C. 154(b) by 0 days.

(21) Appl. No.: 10/255,239

(22) Filed: Sep. 25, 2002

(51) Int. Cl.[7] ..... E01H 5/04

(52) U.S. Cl. ..... 37/234; 37/236; 37/272; 37/414; 701/50; 172/2

(58) Field of Search ..... 37/234, 235, 236, 37/272, 414–417; 701/50; 172/2, 7, 4, 4.5, 8–12

(56) References Cited

U.S. PATENT DOCUMENTS

| | | | | |
|---|---|---|---|---|
| 2,674,052 A | | 6/1954 | Newkirk | |
| 2,858,625 A | | 11/1958 | Rivinus | |
| 3,069,983 A | | 12/1962 | Pizzarotti et al. | |
| 3,144,723 A | | 8/1964 | Carter | |
| 3,656,559 A | | 4/1972 | Lennea et al. | |
| 3,761,040 A | | 9/1973 | Cummins | |
| 3,800,902 A | | 4/1974 | Keller | |
| 3,934,654 A | | 1/1976 | Stephenson et al. | |
| 3,974,882 A | | 8/1976 | Eftefield | |
| 4,081,092 A | | 3/1978 | Zimmerman | |
| 4,162,708 A | | 7/1979 | Johnson | |
| 4,164,821 A | | 8/1979 | Vanchot | |
| 4,231,432 A | * | 11/1980 | Jennings | 172/2 X |
| 4,318,266 A | | 3/1982 | Taube | |
| 4,413,684 A | | 11/1983 | Duncklee | |
| 4,552,226 A | | 11/1985 | Platter | |
| 4,727,665 A | * | 3/1988 | Verseef | 37/236 |
| 4,776,750 A | | 10/1988 | Griswold, Jr. et al. | |
| 4,809,449 A | | 3/1989 | Solaja | |
| 4,991,323 A | | 2/1991 | Benkler | |
| 4,999,935 A | | 3/1991 | Simi et al. | |
| 5,158,495 A | | 10/1992 | Yonezawa | |
| 5,174,385 A | | 12/1992 | Shinbo et al. | |
| 5,224,555 A | | 7/1993 | Bain et al. | |
| 5,265,355 A | | 11/1993 | Daniels | |
| 5,284,097 A | | 2/1994 | Peppin et al. | |
| 5,375,773 A | | 12/1994 | Lewis | |
| 5,524,368 A | | 6/1996 | Struck et al. | |
| 5,647,439 A | | 7/1997 | Burdick et al. | |
| 5,755,387 A | | 5/1998 | Hedrick | |
| 5,778,567 A | | 7/1998 | Jager et al. | |
| 5,909,960 A | | 6/1999 | Jager et al. | |
| 5,988,534 A | | 11/1999 | Kost et al. | |
| 6,035,944 A | * | 3/2000 | Neuner et al. | 172/818 |
| 6,089,478 A | | 7/2000 | Truan et al. | |
| 6,154,986 A | | 12/2000 | Hadler et al. | |

* cited by examiner

*Primary Examiner*—Christopher J. Novosad
(74) *Attorney, Agent, or Firm*—Reinhart Boerner Van Deuren s.c.

(57) ABSTRACT

A snow plow system for use with a skid steer loader includes a V-plow blade that is repositionable by a hydraulic actuator operated by pressurized hydraulic fluid supplied to the actuator from the auxiliary hydraulic output of the skid steer loader. A normally open valve diverts hydraulic fluid away from the actuator whenever the plow blade is not being repositioned, enabling the auxiliary hydraulic system to be maintained actuated. The valve is operated to a closed condition by a wireless remote control receiver which receives coded radio frequency signals transmitted by a wireless, portable, battery-powered transmitter locatable within or outside of a cab of the vehicle, or by a voice-actuated control. A mounting panel of the snow plow system includes an anti-slip surface, providing footing for an operator upon entering or exiting the cab of the vehicle.

35 Claims, 14 Drawing Sheets

PLOW SYSTEM INCLUDING A HYDRAULIC FLUID DIVERTER

BACKGROUND OF THE INVENTION

FIELD OF THE INVENTION

The present invention relates generally to plow systems for mounting on a multi-purpose vehicles, such as skid steer loaders and the like, wherein pressurized hydraulic fluid for operating hydraulic components of the plow system is obtained from the hydraulic system of the vehicle, and more particularly to a plow system including a hydraulic fluid diverter that allows hydraulic fluid to be recirculated back to a reservoir, preventing pressure build up in the hydraulic lines.

Many snow plow systems are designed to be removably mounted on the front of vehicles, such as jeeps, pick-up trucks, and the like. In such applications, the operation of the snow plow is controlled from the cab of the vehicle using a joy stick or other control device that is located within the cab of the vehicle. Such applications require that electrical wires pass through the firewall of the vehicle to provide electrical connections between the control device located within the cab to the electrical components, such as coils of hydraulic actuators, that are located near the front of the vehicle and/or on the snow plow. In addition, the electrical components of the snow plow use the battery of the vehicle as a source of electrical power, necessitating electrical connections between these components and the vehicle battery. Further connections are required between hydraulic components of the snow plow and the hydraulic supply of the vehicle. In most instances it also is necessary to attach a frame to the vehicle to support the snow plow and its hydraulic and electrical operating components. Thus, the removable mounting of a snow plow on a vehicle usually requires that several connections, both mechanical and electrical, be made.

In recent years, plow systems have been removably mounted on multi-purpose vehicles, such as skid steer loader-type vehicles. For example, U.S. Pat. No. 6,035,944 discloses a plow blade mounting system for mounting an adjustable V-plow blade on a skid steer loader-type vehicle and the like. This application provides a quick release-type mounting of the plow to the tool mounting plate of the skid steer loader. Although this arrangement simplifies the mechanical connections necessary for mounting a plow on a vehicle, electrical power for the plow is obtained from the vehicle battery and thus, connections must be made to the vehicle battery in addition to connections to the auxiliary hydraulic output of the skid steer vehicle.

A further consideration is that obtaining pressurized hydraulic fluid for operating hydraulic components of the plow system from the auxiliary hydraulic output of the skid steer loader places constraints on the operation of the plow system. The auxiliary hydraulic output must be deactivated whenever the V-plow blade is not being repositioned and must be activated by the operator when the plow blade is to be repositioned. Because the hydraulic controls of the skid steer loader are used to reposition the plow blade, the operator must be located in the cab of the skid steer loader to make any adjustments in the angling of the plow blade.

Moreover, access to and egress from the cab of the skid steer loader typically is through a door that is located on the front of the skid steer loader as is known. Because the upper edge of the metal mounting panel of the plow is located just forward of the door, the operator typically uses the upper edge for footing whenever entering or exiting the cab, which can present a hazardous condition if the operator should loose footing.

SUMMARY OF THE INVENTION

The invention provides a plow system for use with a vehicle having a hydraulic system that supplies hydraulic fluid under pressure continuously to a hydraulic fluid outlet when the hydraulic system is operating in an active mode. The plow system includes a repositionable plow blade, a hydraulic actuator coupled to the plow blade and a hydraulic control system including a pressure head that supplies hydraulic fluid from the fluid outlet to the hydraulic actuator for repositioning the plow blade. A bypass device diverts hydraulic fluid away from the hydraulic actuator when the hydraulic system is operating in the active mode and the plow blade is not being repositioned.

In one embodiment, the vehicle can be a skid steer loader and the hydraulic fluid outlet is an auxiliary hydraulic output of the skid steer loader.

In such embodiment, the bypass device allows the auxiliary hydraulic system to be maintained activated even when the plow blade is not being repositioned. In one embodiment, the bypass device is a normally open valve that is connected between a fluid inlet and a fluid outlet of the pressure head, allowing hydraulic fluid to be recirculated back to the reservoir to thereby prevent pressure build up in the hydraulic fluid flow path to the hydraulic actuator whenever the plow blade is not being repositioned.

In one embodiment, the plow system includes wireless remote radio frequency control of the operation of the bypass device. The plow system includes a wireless remote control transmitter which transmits coded radio frequency signals and a wireless remote control receiver which receives the coded radio frequency signals. In response to the coded frequency signals, the receiver provides an activating signal for causing the bypass device to allow hydraulic fluid to be supplied to the hydraulic actuator or actuators for repositioning the plow blade. Preferably, the transmitter is a self-contained, battery-powered portable device locatable within a cab of the vehicle or at a location outside of the cab of the vehicle.

In another embodiment, the plow system includes a voice-actuated control.

Further in accordance with the invention, there is provided a snow plow system for use with a skid-steer loader having an auxiliary hydraulic output. The snow plow system includes a repositionable V-plow blade, a support structure supporting the V-plow blade and hydraulic actuators for repositioning the V-plow blade. A control unit supported by the support structure operates the hydraulic actuators to reposition the V-plow blade. A hydraulic control unit includes a pressure head that is interposed between the auxiliary hydraulic fluid outlet and the hydraulic actuators. The pressure head defines a first fluid flow path for supplying hydraulic fluid under pressure to the hydraulic actuators for operating the hydraulic actuator and a second fluid flow path. A bypass device diverts hydraulic fluid away from the first fluid flow path and returns the hydraulic fluid to a hydraulic fluid reservoir when the hydraulic system is operating in the active mode and the V-plow blade is not being repositioned.

In accordance with another aspect of the invention, there is provided a plow system for use with a skid-steer loader wherein access to and egress from a cab of the skid steer loader is through a doorway located at the front of the skid steer loader. The plow system includes a plow blade and a support structure supporting the plow blade to enable repositioning of the plow blade. The support structure includes a vertically extending panel, the upper edge of which is located forward of the doorway, enabling an operator to use the upper edge of the panel for footing upon entering or exiting the cab. The upper edge of the panel defines an anti-slip surface. In one embodiment, the upper edge of the panel is of patterned steel providing the anti-slip surface. In another embodiment, the upper edge of the panel includes a layer of non-slip material to provide the anti-slip surface.

BRIEF DESCRIPTION OF THE DRAWINGS

The features of the present invention which are believed to be novel are set forth with particularity in the appended claims. The invention, together with the further objects and advantages thereof, may best be understood by reference to the following description taken in conjunction with the accompanying drawings, wherein like reference numerals identify like elements, and wherein:

DETAILED DESCRIPTION OF THE PREFERRED EMBODIMENTS

Figure 1:
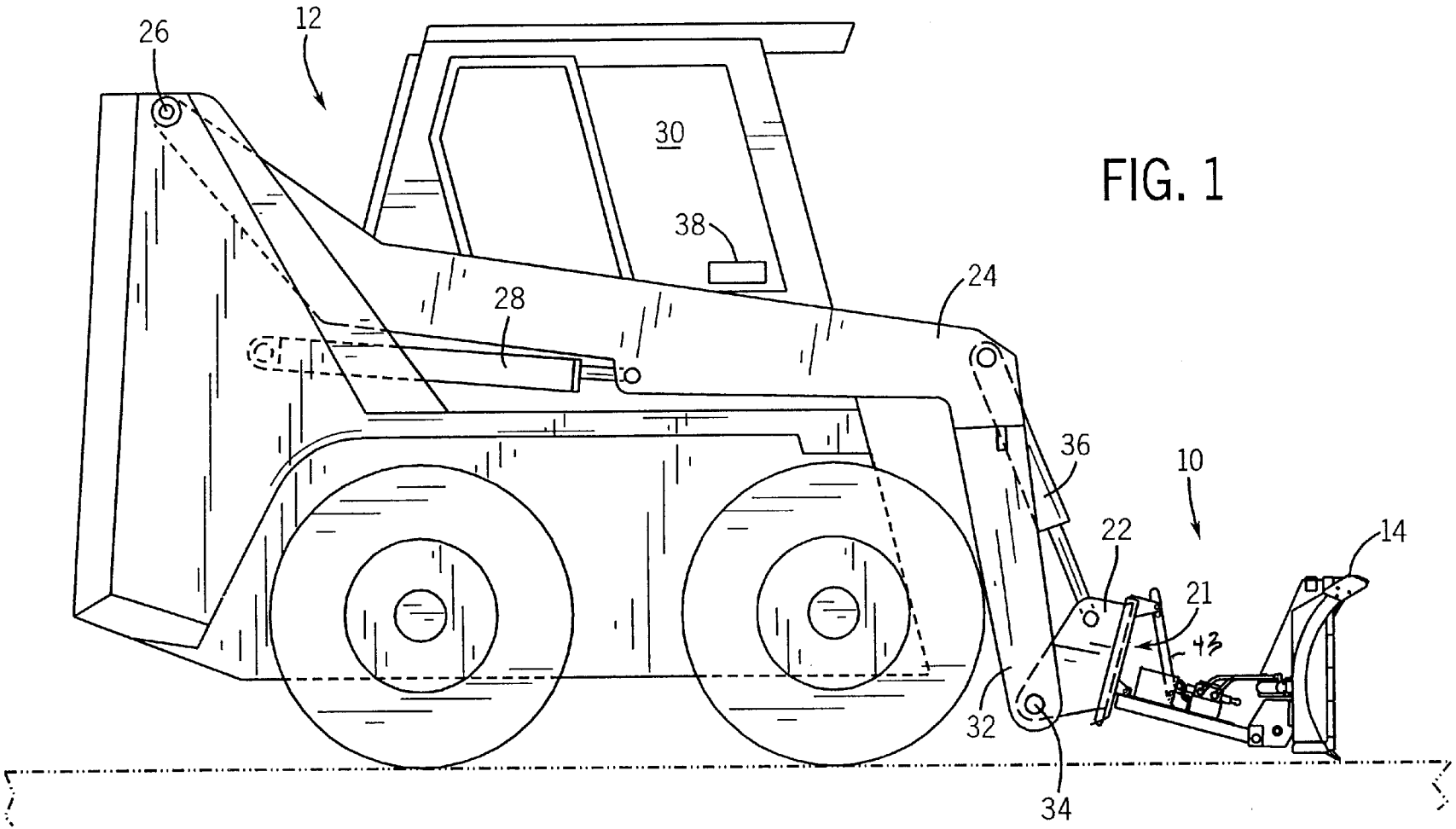
FIG. 1 is a side view showing a plow system of the present invention mounted to a skid steer loader.
Figure 2:
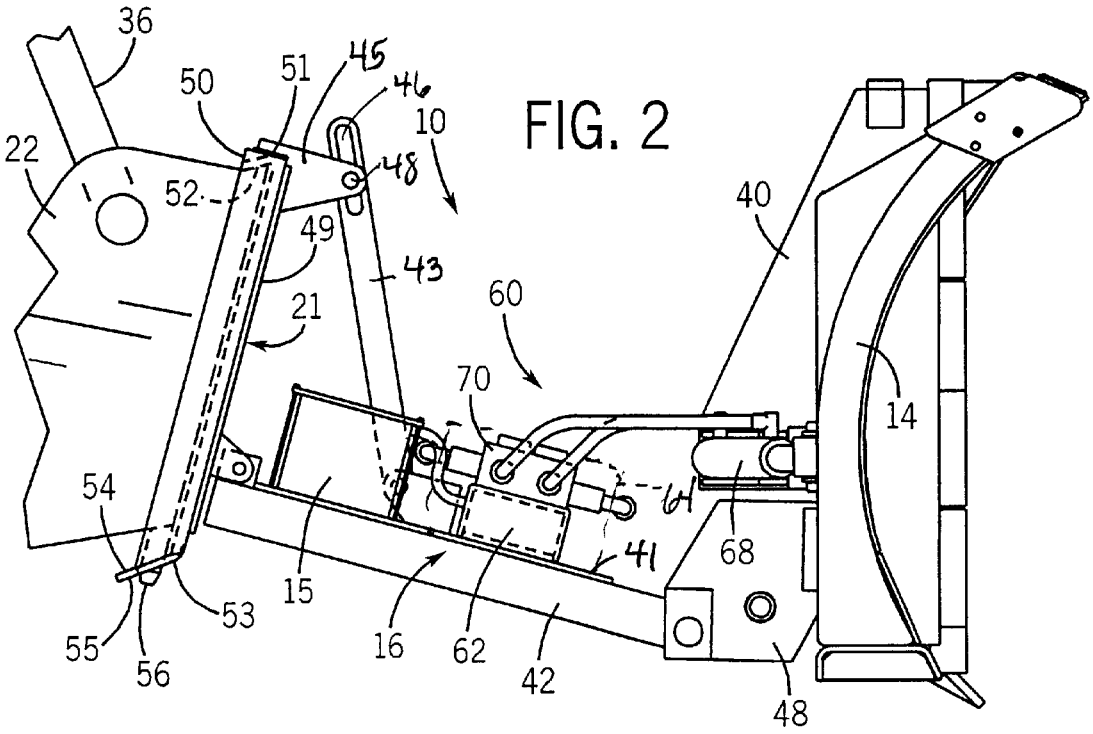
FIG. 2 is an enlarged, side elevation view of the plow system of FIG. 1 and showing the mounting arrangement for mounting the plow system to the skid steer loader.
Figure 3:
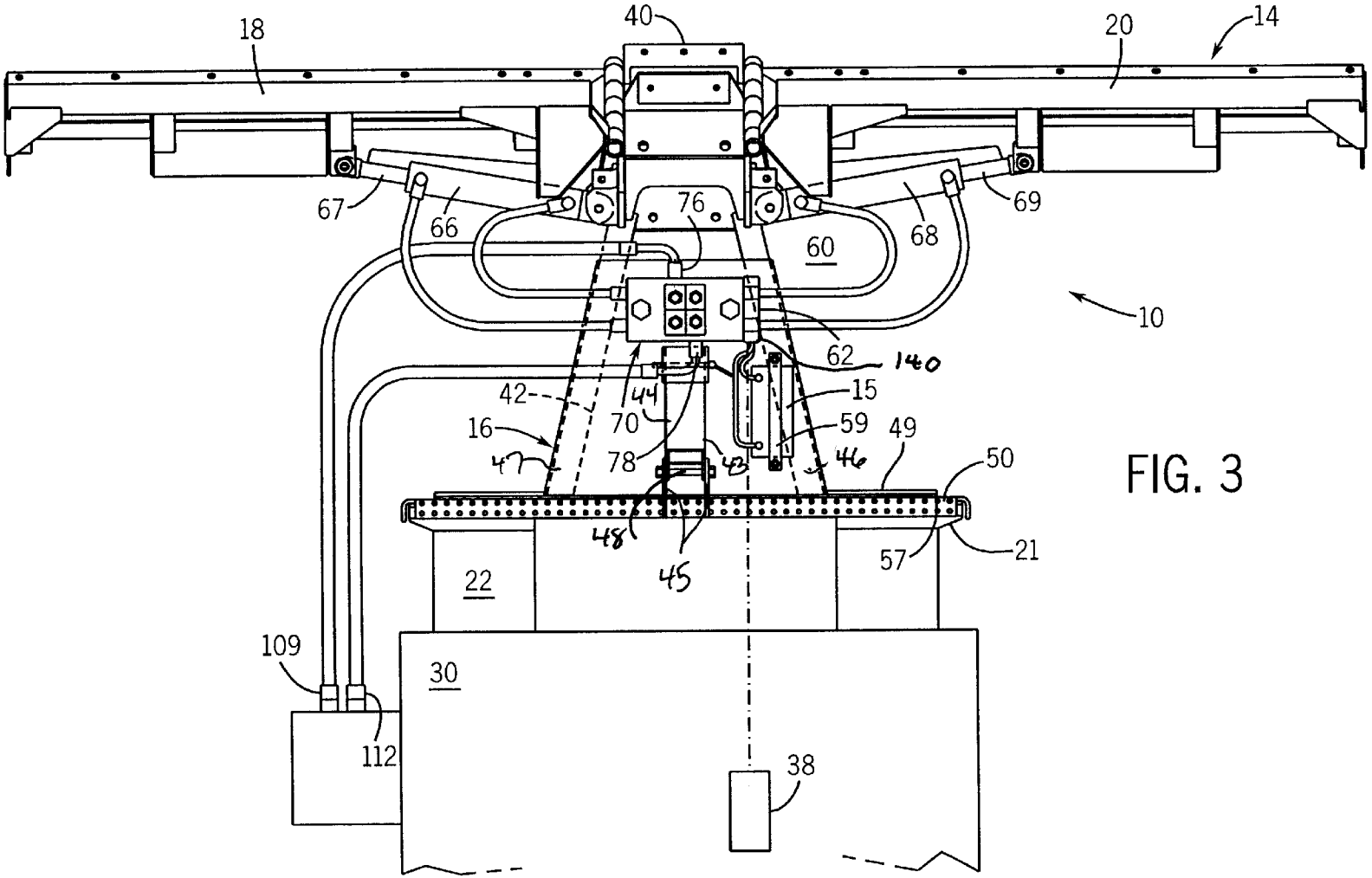
FIG. 3 is a top plan view of the plow system shown mounted to the skid steer loader.

Referring to FIGS. 1–3 of the drawings, there is shown a plow system 10 provided by the present invention. By way of illustration of the invention, the plow system 10 is described with reference to an application in which the vehicle to which the plow system 10 is mounted is a skid-steer loader-type vehicle 12. Although the plow system is described with reference to an application for mounting to skid-steer loaders, and the like, with suitable modification as to its mounting arrangement, the plow system can be used on other vehicles such as highway trucks, pick-up trucks, and the like, for example. In addition, in one preferred embodiment, the plow system 10 is operated as a snow plow. However, the plow system 10 can be used for other applications such as earth working.

In accordance with the invention, the plow system 10, hereinafter snow plow, is a self-contained, battery-operated unit. By self-contained is meant that the hydraulic, electrical and electronic controls of the snow plow, as well as the battery 15 which supplies electrical power to the electrical and electronic controls of the snow plow system, can be mounted on the support structure of the snow plow 10. Accordingly, the snow plow 10, including the plow blade and the hydraulic, electrical and electronic components, that control the positioning of the plow blade, can be removed easily and quickly as a single unit from the skid-steer loader 12. Such removal simply requires disconnecting of the hydraulic supply and return hoses and the release of the quick disconnect mechanism of the skid-steer loader.

In one embodiment, the snow plow 10 includes an articulated plow blade 14 having multi-position left and right wing blades 18 and 20 which are adjustable to "V" and "scoop" configurations and all positions in between such as the positions shown in FIGS. 4A–4I, for example. The repositioning of the left and right wing blades 18 and 20 of the "V" plow blade 14 is controlled remotely using radio frequency (RF) wireless signaling as will be described. In another embodiment, the plow system can include a straight blade and the hydraulic, electrical and electronic components can change the angle of the plow blade with respect to the direction of travel of the skid steer loader. This embodiment can be used, for example, where the skid steer loader is operated in hazardous conditions and in which the operation of the skid steer loader is controlled remotely by the skid steer operator.

The snow plow 10 includes a mounting adapter, indicated generally at 21, which facilitates quick-release, removable attachment or mounting of the snow plow 10 to the mounting plate 22 of the skid-steer loader 12. The snow plow 10 uses the hydraulic system of the skid-steer loader 12 as a source of pressurized hydraulic fluid for operating hydraulic actuators to make angular adjustment of the left and right wing blades of the plow blade. Vertical up and down movement of the plow blade 14 is accomplished by raising and lowering the mounting plate 22 or load arms 24 of the skid-steer loader 12.

Skid-steer Unit

Referring to FIG. 1, the, skid-steer loader 12 includes a hydraulically operated, vertical lift mechanism which includes a pair of lift arms, such as lift arm 24, extending forwardly of the vehicle. The lift arms are pivoted near the rear of the skid-steer loader and can be pivoted about pivot points, such as pivot point 26 for lift arm 24, by hydraulic cylinders, such as hydraulic cylinder 28 for lift arm 24. The operation of the hydraulic cylinders can be controlled from the cab 30 of the skid-steer loader 12 by means of operator controls in the cab of the skid-steer loader, typically a hand lever or a foot pedal control.

The forward ends 32 of the lift arms include a horizontal pivot 34 on which is mounted the mounting plate 22, commonly referred to as an attachment tool carrier plate. Typically, a loader bucket is mounted on the tool carrier plate 22. The pitch of the tool carrier plate 22 and an implement mounted thereon is controlled by a hydraulic actuator 36. The tool carrier plate 22 can include one or more mounting positions. The snow plow 10 is removably mounted to the carrier plate 22 of the skid-steer loader 12 by the mounting adapter 21 as will be described. The plow blade 14 can be raised and lowered by raising and lowering the tool carrier plate 22 of the skid-steer loader.

Snow Plow

Considering the snow plow 10 in more detail, with reference to FIGS. 2 and 3, the articulated blade 14 is supported by the support frame 16 at the forward end of the support frame 16. The support frame 16 can include an A-frame member 42 to which is mounted a center tower 40 which supports the plow blade 14.

The left wing blade 18 and right wing blade 20 of the articulated V-plow blade 14 are pivotally mounted to a center tower 40 that defines pivots for the left and right wing blades. The positioning and orientation of the left and right wing blades 18 and 20 can be controlled from within or from outside of the cab of the skid-steer loader 12 as will be shown. The snow plow 10 can include one or more trip springs (not shown) for providing trip action for the plow blade 14 in the manner known in the art.

The forward end of the A-frame member 42 is coupled by a pair of slide links 43,44 to a pair of brackets 45 projecting forwardly from the adapter plate. Each of the slide links, such as slide link 43, has a slot 46 near the upper end thereof and an aperture 47 near the lower end for attachment to the A-frame. A pin 48 rides in the slots, providing a degree of freedom for the plow blade. The pin can engage bushings (not shown) in the links 43,44, allowing the pin 48 to float in the slots. To apply downpressure, the skid steer arms, such as arm 24 are lowered so that the pin 48 reaches the bottom of the slots 46 and then pushes down on the mounting. When the skid steer arms are lifted, the pin 48 is moved to engage the top of the slots 46, raising the plow unit.

The mounting adapter 21 is attached to the support frame 16 at the rearward end thereof. The mounting adapter 21 can be attached to the A-frame member 42 by welding or by fasteners, such as machine bolts, pivot pins or in any other suitable manner.

Referring to FIG. 2, in one embodiment, the mounting adapter 21 includes a plate or panel 49 that is generally rectangular in shape. The upper edge 50 of the panel includes an inverted V-shaped channel 51 that mates with the upper edge 52 of the carrier plate 22 of the skid-steer loader. The bottom end 53 of the panel 49 includes a rearwardly directed portion 54 which includes one or more apertures 55 which receive locking pins 56 of a quick release mechanism of the skid-steer loader for locking the mounting adapter 21 to the skid-steer loader in the manner known in the art. The quick release mechanism can be conventional. In one embodiment, the quick release mechanism of the tool carrier plate includes two pins which are located on opposite sides of the tool carrier plate 22 adjacent to the bottom ends. The pins of the quick release mechanism are disposed to be extended into and retracted out of one of the apertures of bottom end when the quick release mechanism is operated by an operator.

Referring to FIGS. 1–3, access to and egress from the cab 30 of the skid-steer loader 12 is through a door located on the front of the skid-steer loader as is known. Because the upper edge 50 of the adapter panel 49 of the snow plow is located just forward of the door, the operator typically uses the upper edge 50 for footing whenever entering or exiting the cab 30.

In one embodiment, the upper edge 50 of the panel 49 of the mounting adapter 21 includes a non-slip surface, indicated at 57 in FIG. 3, to provide an anti-slip surface. In one embodiment, the non-slip surface can be provided by a patterned steel. Alternatively, a layer of non-slip material, such as the anti-slip abrasive floor tread material, that is commercially available from 3M Company, can be disposed on the upper edge 50 of the panel 49.

The snow plow 10 includes a hydraulic control system, indicated generally at 60, and a control unit 62 hereinafter electronic controller. The control components of the hydraulic control system and the electronic controller are mounted on the support frame 16. In one embodiment, the control components of the hydraulic control system and the electronic controller 62 are carried by a platform that is supported on the A-frame member 42. The battery 15 also can be supported on the platform 41. Suitable hold downs, such as hold down 59 for the battery 15, can be provided to secure the battery 15 and the electronic controller 62 to the platform 41.

In one embodiment, a cover 64 (FIG. 2) is mounted on the beams 46 and 47 of the A-frame member 42 to at least partially enclose the electronic controller 62 and a manifold or pressure head 70 of the hydraulic control system 60 as well as the battery 15. In one embodiment, the cover 64 includes a top 64*a* which can substantially conform to the shape of the A-frame. The cover 64 can be a one-piece member of a rigid plastic material and can be transparent, translucent or opaque. Alternatively, the cover can be made of steel or some other rigid material, allowing the cover to be used for footing by the operator as the operator upon entering or exiting the cab. The cover can be maintained in place on beams 46 and 47 of the A-frame in any suitable manner. In embodiments that do not include the beams 46 and 47, the cover can be configured to allow the cover to be mounted directly on the A-frame member 42.

Hydraulic Control System

Referring to FIGS. 3 and 6–14, the hydraulic control system 60 includes a left wing blade actuator, such as a piston cylinder 66 having a piston rod 67, a right wing blade actuator, such as a piston cylinder 68 having a piston rod 69 and the manifold or pressure head 70 through which hydraulic fluid is supplied to the piston cylinders 66 and 68. In one embodiment, the piston cylinders 66 and 68 are double acting hydraulic cylinders, the respective piston rods 67 and 69 being movable individually from a centered or idle position, illustrated in FIGS. 3 and 4A, to an extended position, shown in FIG. 4B, for example, or to a retracted position, shown in FIG. 4C, for example. In the extended position, both wing blades 18 are 20 pivoted forwardly. In the retracted position, both wing blades 18 are 20 pivoted rearwardly. The wing blades 18 and 20 can be operated separately to extended or retracted positions, as illustrated in FIGS. 4A–4I, for example.

Figure 15:
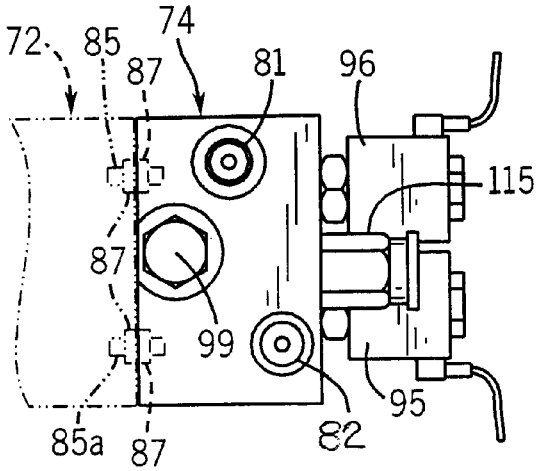
FIG. 15 is a left side elevation view of the top valve block of FIG. 13, with the top valve block shown mounted on the bottom valve block which is shown in phantom.
Figure 16:
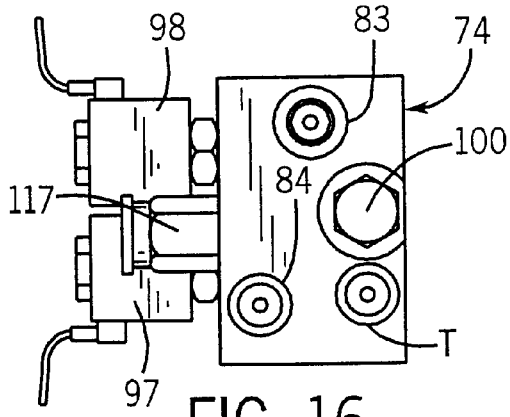
FIG. 16 is a right side elevation view of the top valve block of FIG. 13.
Figure 17:
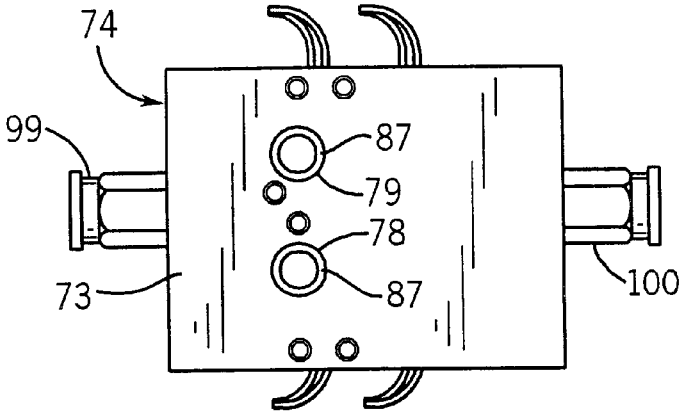
FIG. 17 is a bottom plan view of the top valve block of FIG. 13.

In one embodiment, the pressure head 70 includes a bottom valve block 72, shown in FIGS. 8–12, and a top valve block 74, shown in FIGS. 13–17. The top valve block is mounted on the bottom valve block 72 as illustrated in FIG. 15 and can be secured to the bottom valve block 72 in any suitable manner. In another embodiment, the pressure head is a single valve block that provides the functions of the top and bottom valve blocks 72 and 74.

Referring to FIGS. 6, 7 and 8–12, the bottom valve block 72 includes a pressure fluid inlet port 75 and a return fluid outlet port 76. The pressure inlet port 75 receives pressurized hydraulic fluid from a source of hydraulic fluid for operating the hydraulic piston cylinders. In one preferred embodiment, the source of pressurized hydraulic fluid is provided by the hydraulic system of the skid-steer loader 12. As will be shown, the skid-steer loader 12 includes an auxiliary hydraulic fluid system which provides hydraulic fluid under pressure at an outlet 109 whenever the auxiliary hydraulic fluid system is activated. The return outlet port 76 is communicated with a return line 111 to allow the hydraulic fluid to be returned through return line 111 to a reservoir 113 of the fluid source.

The pressure head 70 also includes a bypass device which in one embodiment is a direction control valve 86, a flow controller 88 and a pressure sensing device, such as a pressure relief valve 90, which, in one embodiment, has an operating pressure set point of 1700 pounds per square inch (psi). The direction control valve 86 is mounted on the bottom valve block 72, interposed between the pressure inlet port 75 and the return outlet port 76 of the bottom valve block 72. In one embodiment, the direction control valve 86 can be a two-way, normally open poppet-type valve. The direction control valve 86 includes an operate coil 89. The direction control valve 86 is a two-state device that in one state provides a bypass condition in which hydraulic fluid flow is diverted from the top valve block 74 and in the second state a condition in which hydraulic fluid is supplied to the top valve block 74 for operating the hydraulic actuators 66 and 68.

Referring to FIGS. 6–9 and 17, the flow controller 88 is mounted on the bottom valve block 72 with its fluid flow path interposed between the pressure inlet port 75 of the bottom valve block 72 and a pressure outlet port 77 of the bottom valve block 72. The pressure outlet port 77 is connected to a pressure fluid inlet port 78 of the top valve block 74. The flow controller 88 provides flow compensation to maintain substantially constant the flow of the hydraulic fluid being supplied to the top valve block 74.

The pressure relief valve 90 is mounted on the bottom valve block 72 interposed between the pressure inlet port 75 and return outlet port 76 of the bottom valve block 72 in parallel with the direction control valve 86. The pressure relief valve 90 responds to an overpressure condition to dump hydraulic fluid to a hydraulic fluid return line 111. The flow controller 88 and the pressure relief valve 90 can be contained within or mounted on the pressure head 70.

Referring to FIGS. 6, 7 and 13–17, the top valve block 74 mounts a left wing blade extend valve 91, a left wing blade retract valve 92, a right wing blade extend valve 93, and a right wing blade retract valve 94, together with check valves 101–104 and crossover relief valves 105–108 of the hydraulic control system 60. In one embodiment, the crossover relief valves 105–108 have an operating pressure set point of 2100 psi. The top valve block 74 further includes wing relief valves 99 and 100 which, in one embodiment, have an operating pressure set point of 2100 psi. In another embodiment, a single four-way, three-position valve provides the functions of the left wing blade extend valve 91 and the left wing blade retract valve 92. A further four-way, three-position valve can be used to provide the functions of the right wing blade extend valve 91 and the right wing blade retract valve 92. Check valves 101–104 are not required in this embodiment.

In one embodiment, the pressure fluid inlet port 78 of the top valve block 74 is located in the bottom surface 73 of the top valve block 74 and the pressure outlet port 77 of the bottom valve block 72 is located in the top surface 71 (FIG. 8) of the bottom valve block 72. The top valve block 74 is mounted on the bottom valve block 72 with surface 73 overlying surface 71 such and with the pressure inlet port 78 disposed in alignment with and in overlying relation with the pressure outlet port 77. The pressure inlet port 78 of the top valve block 74 can be connected in fluid communication with the pressure outlet port 77 of the flow controller 88 of the bottom valve block 72 by means of a hollow tube 85, the opposite ends of which are received in the ports 77 and 78. A suitable sealing device, such as an O-ring (not shown), can be provided between the tube 85 and the ports 77 and 78.

Similarly, a return fluid outlet port 79 of the top valve block 74 is located in the bottom surface 73 of the top valve block 74, in an aligned overlying relationship with a return fluid inlet port 80 of the bottom valve block 72 located in the top surface 71 of the bottom valve block 72. The return outlet port 79 is connected in fluid communication with return inlet port 80 of the bottom valve block 72 by means of a hollow tube 85*a*, the opposite ends of which are received in the ports 79 and 80. Return outlet port 80, and thus return outlet port 79, is in fluid communication with the return outlet port 76 which, in turn, is in fluid communication with the return line 111 for the hydraulic system of the snow plow 10. A suitable sealing device, such as an O-ring (not shown), can be provided between the tube 85 and the ports 79 and 80. In one embodiment, the mating ports 77,78 and 79,80 are countersunk as indicated at 87 in FIG. 16, such that each pair of mating ports defines a cavity for locating one of the O-rings.

The top valve block 74 includes an extend outlet port 81 and a retract outlet port 82 for the left piston cylinder 66 and an extend outlet port 83 and a retract outlet port 84 for the right piston cylinder 68. Port 81 is connected by a left extend line 121 to an extend port at one end of the piston cylinder 66. Port 82 is connected by a left retract line 122 to a retract port at the rod end of the piston cylinder 66. Port 83 is connected by a right extend line 123 to an extend port at one end of the piston cylinder 68. Port 84 is connected by a right retract line 124 to a retract port at the rod end of the right wing blade actuator.

The left wing blade extend valve 91 and check valve 101 control the supply of fluid from the pressure line 110 to the piston cylinder 66 through left extend line 121. In addition, the left wing blade extend valve 91 and check valve 101 permit the dumping of hydraulic fluid from the piston cylinder 66 to the reservoir 113 through left extend line 121 and return line 111. The left wing blade retract valve 92 and check valve 102 control the supply of fluid from the pressure line 110 to the piston cylinder 66 through left retract line 122. In addition, the left wing blade retract valve 92 and check valve 102 permit and the dumping of hydraulic fluid from the piston cylinder 66 to the reservoir through left retract line 122 and return line 111. The right wing blade extend valve 93 and check valve 103 control the supply of fluid from the pressure line 110 to the piston cylinder 68 through right extend line 123. In addition, the right wing blade extend valve 93 and check valve 103 permit the dumping of hydraulic fluid from the piston cylinder 68 to the reservoir 113 through right extend line 123 and return line 111. The right wing blade retract valve 94 and check valve 104 control the supply of fluid from the pressure line 110 to the piston cylinder 68 through right retract line 124. In addition, the right wing blade retract valve 94 and check valve 104 permit the dumping of hydraulic fluid from the piston cylinder 68 to the reservoir through right retract line 124 and return line 111. The valves 91–94 are operable between a first state in which pressurized hydraulic fluid on the pressure line 110 is supplied to the hydraulic actuators and a second state with which hydraulic fluid is returned to return line 111. The valves 91–94 normally are maintained in the second state. Hydraulic fluid is diverted from the bypass condition to the condition of supplying the extend and retract valves 91–94 and the piston cylinders 66 and 68 simultaneously with the activation of any of the valves 91–94 and reverts to the bypass condition simultaneously with the deactivation of any of the valves 91–94, this operation occurring without the need for any separate or independent switching.

Figure 7:
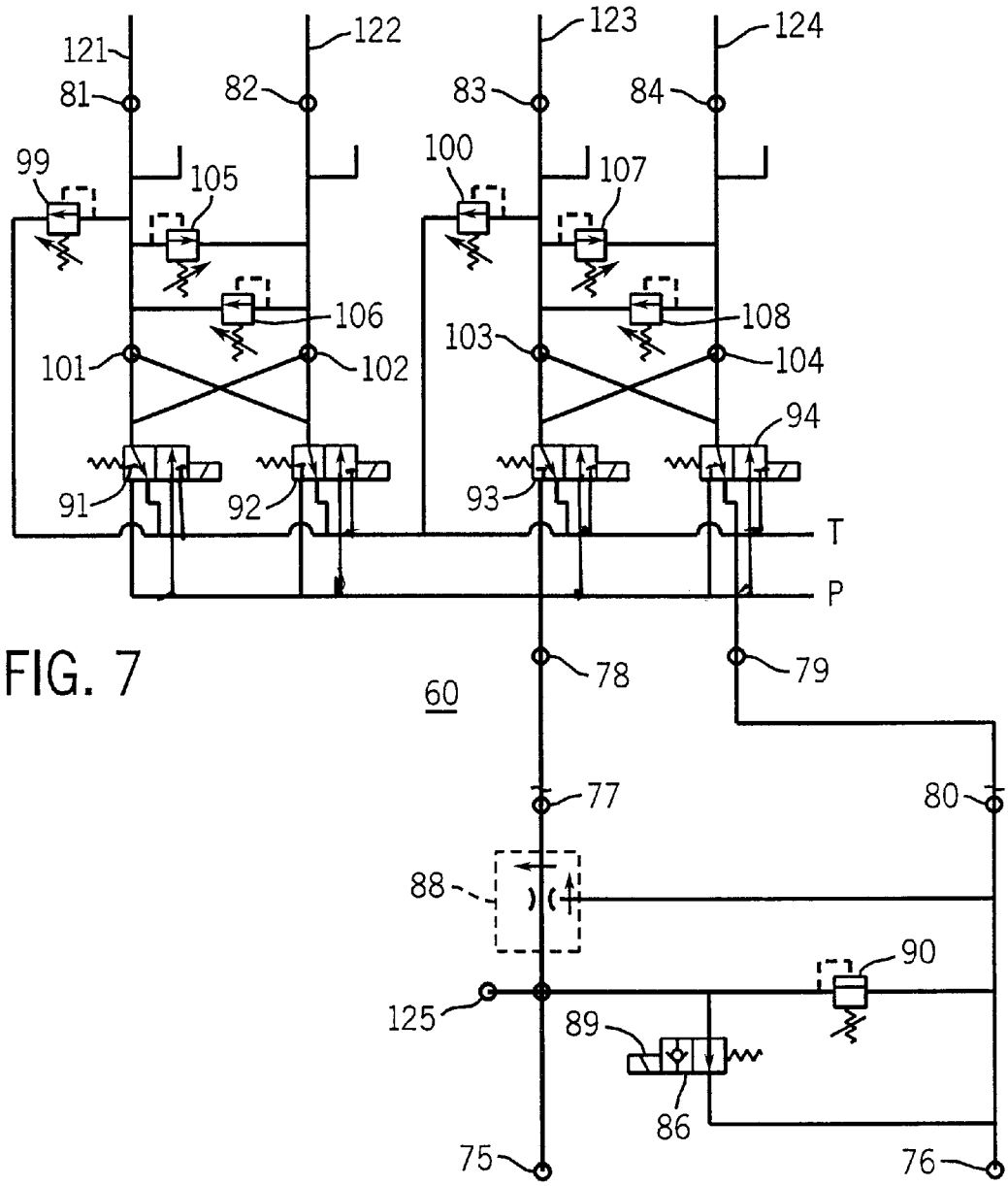
FIG. 7 is a schematic diagram of the hydraulic components of the plow system.

Referring to FIG. 7, the check valves 101–104 are pilot operated valves. The pilot input of check valve 101 is connected to the output of the left wing blade retract valve 92 to be operated to the open condition to communicate left extend line 121 to return line 111 through left wing blade extend valve 91 whenever the left wing blade retract valve 92 is operated to supply pressurized fluid to left retract line 122. The pilot input of check valve 102 is connected to the output of the left wing blade extend valve 91 to be operated to the open condition to communicate left retract line 122 to return line 111 through left wing blade retract valve 92 whenever the left wing blade extend valve 91 is operated to supply pressurized fluid to the left extend line 121. Similarly, the pilot input of check valve 103 is connected to the output of the right wing blade retract valve 94 to be operated open to communicate right extend line 123 to return line 111 through right wing blade extend valve 93 whenever the right wing blade retract valve 94 is operated to supply pressurized fluid to right retract line 124. The pilot input of check valve 104 is connected to the output of the right wing blade extend valve 93 to be operated to the open condition to communicate right retract line 124 to return line 111 through right wing blade retract valve 94 whenever the right wing blade extend valve 93 is operated to supply pressurized fluid to the right extend line 123.

Crossover relief valve 105 is connected, to provide unidirectional flow from the left extend line 121 to the left retract line 122 and crossover relief valve 106 is connected to provide unidirectional flow from the left retract line 122 to the left extend line 121. Similarly, crossover relief valve 107 is connected to provide unidirectional flow from the right extend line 123 to the right retract line 124 and crossover relief valve 108 is connected to provide unidirectional flow from the right retract line 124 to the right extend line 123. In one embodiment, the function of crossover relief valves 105 and 106 is provided by a single valve structure 115 and the function of crossover relief valves 107 and 108 is provided by a single valve structure 117. Wing relief valve 99 is connected between the left extend line 121 and return outlet port 79 and thus the return line 111, and wing relief valve 100 is connected between the right extend line 123 and return outlet port 79 and thus the return line 111.

Referring to FIGS. 7–17, the bottom valve block 72 can include a gauge pressure port 125 that allows measuring and/or monitoring of the pressure of hydraulic fluid at the inlet port 75 of the bottom valve block. The top valve block 74 can include one or more gauge pressure ports, such as gauge pressure ports 126 (FIG. 15) and 127 (FIG. 16), that allow measuring and/or monitoring of the pressure of hydraulic fluid at the left and right retract lines 122 and 124, respectively. Additional ports, labeled P and T in FIGS. 7, 14 and 16, allow measuring and monitoring of pressure at the pressure inlet port 78 and the return outlet port 79 of the top block. Further gauge pressure ports, not shown, allow measuring and/or monitoring of the pressure of hydraulic fluid at the left and right extend lines 121 and 123.

In the embodiment in which the plow blade is a straight blade, only one-half of the top valve block hydraulic circuit is used. For example, the left extend and retract valves 91 and 92 and the associated check valves 101,102 and pressure relief valves 99, 105 and 106 can control a single actuator for adjusting the angle of the single blade.

Hydraulic Fluid Source

Figure 6:
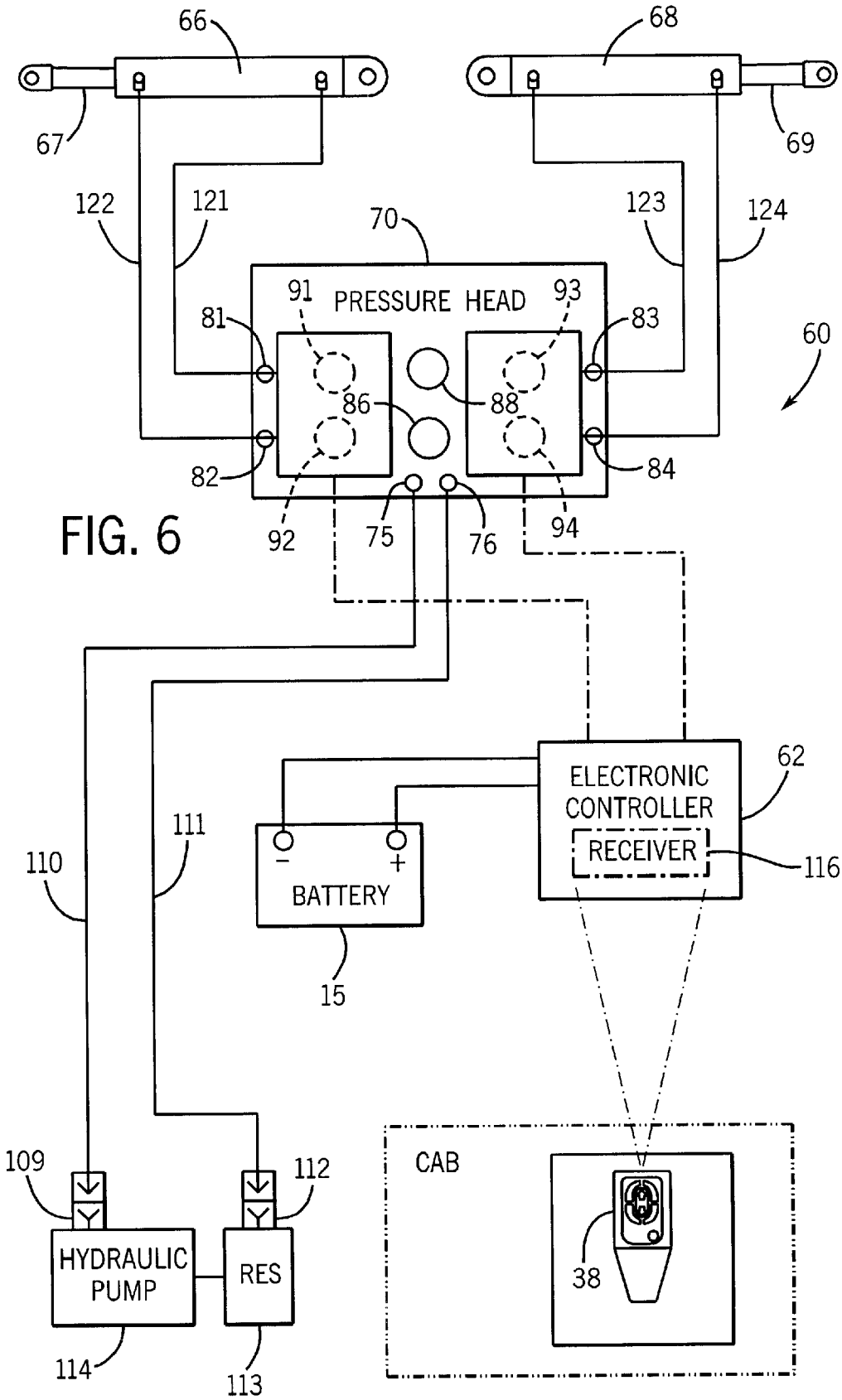
FIG. 6 is a block diagram of the electrical and hydraulic components of the plow system.

Referring to FIG. 6, in one preferred embodiment, the source of pressurized hydraulic fluid is provided by the hydraulic system of the skid-steer loader 12. The skid-steer loader 12 includes an auxiliary hydraulic fluid outlet which typically is located near the front of the skid-steer loader. The hydraulic system of the snow plow is coupled to the auxiliary hydraulic system at fluid outlet 109 of the skid-steer loader 12. To this end, the pressure inlet port 75 of the pressure head 70 is connected through a supply hydraulic hose or line 110 to the auxiliary hydraulic fluid outlet 109 of the hydraulic system of the skid-steer loader 12. A hydraulic fluid return hose or line 111 is connected between the return outlet port 76 of the pressure head 70 and a return port 112 of the hydraulic system of the skid-steer loader 12. The return port 112 is communicated with a hydraulic fluid reservoir 113 of the hydraulic system of the skid-steer loader 12. The hydraulic system of the skid-steer loader 12 includes a hydraulic pump 114 which supplies hydraulic fluid under pressure from a hydraulic fluid reservoir 113 to the hydraulic system of the snow plow.

One shortcoming of using the auxiliary output of the skid-steer loader as the source, of pressurized hydraulic fluid is that pressurized hydraulic fluid is supplied to the hydraulic system of the snow plow whenever the pump 114 of the skid-steer loader is operating. Accordingly, in prior art snow plow systems, such as the one disclosed in U.S. Pat. No. 6,035,944, which use the auxiliary hydraulic system of a skid-steer loader as a source of pressurized hydraulic fluid, the auxiliary hydraulic system must be shut "off" whenever the snow plow blade is not being repositioned to prevent pressure build up in the hydraulic lines. Because the control for turning "on" and "off" the auxiliary output is located within the cab, the operator must be in the cab 30 of the vehicle to turn the auxiliary system activated or "on" to make an adjustment in the blade orientation and to turn "off" the auxiliary hydraulic system after the adjustment has been made.

In accordance with one aspect of the present invention, the hydraulic control system provides a bypass arrangement which enables the auxiliary hydraulic system of the skid-steer loader to be maintained "on" even when the snow plow blade is not being adjusted. The bottom valve block 72 enables the pressurized hydraulic fluid supplied to the hydraulic system of the snow plow to be circulated back to the reservoir 113 of the skid-steer loader. When the auxiliary hydraulic system is "on" and the snow plow blade is not being repositioned, the direction control valve 86 diverts hydraulic fluid away from the piston cylinders. When repositioning of the snow plow blade is required, the direction control valve 86 is operated to cause the hydraulic fluid to be directed to the top valve block 74 to be supplied, selectively, to the hydraulic piston cylinders 66 and 68 through one or both left and right wing blade extend valves 91 and 93, when the valves are operated, or respective wing blade retract valves 92 and 94, when operated, for changing the angle of the wing blades 18 and 20 of the plow blade 14. As described above, the plow blade 14 is raised and lowered by raising and lowering the tool carrier plate 22 of the skid-steer loader.

Electronic Controller

Figure 5:
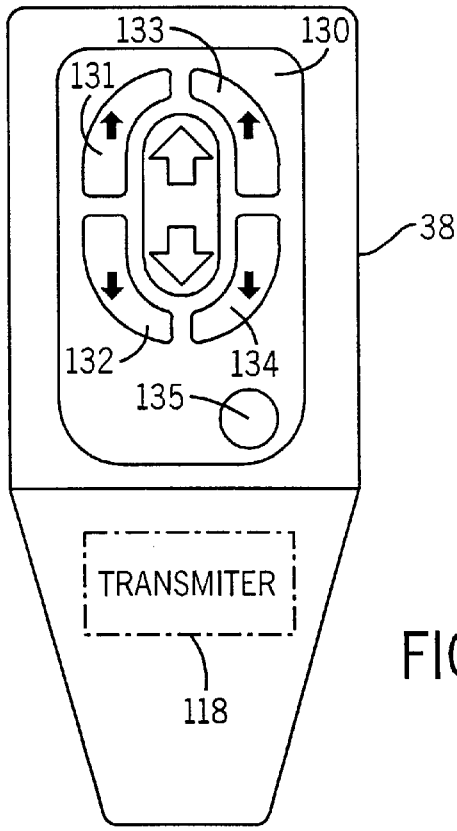
FIG. 5 is a plan view of a remote control unit for the plow system.
Figure 18:
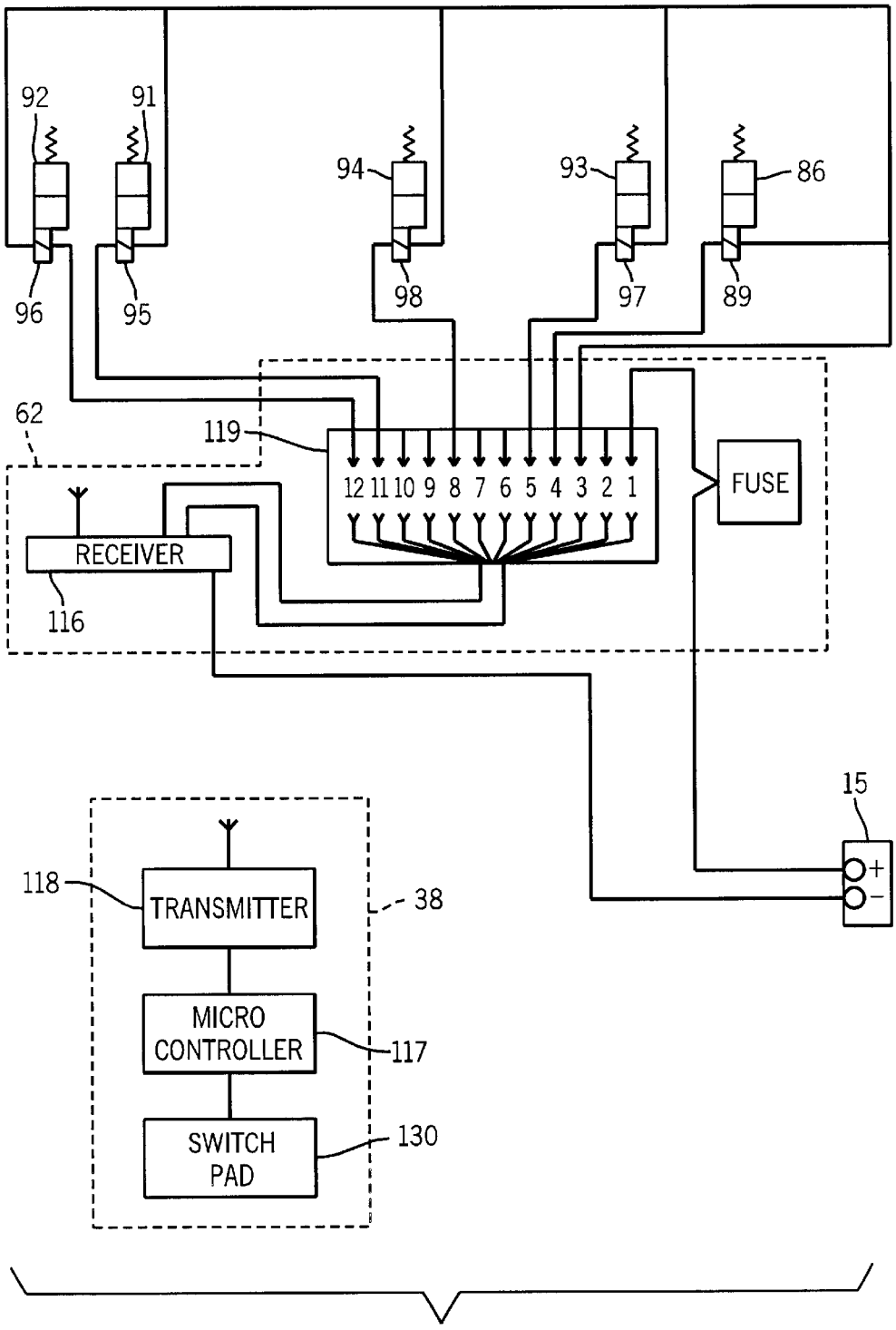
FIG. 18 is a schematic diagram of electrical components of the plow system.

Referring to FIGS. 5, 6 and 18, the repositioning of the left and right wing blades of the plow blade 14 is controlled by the electronic controller 62 which is mounted on the snow plow 10 as shown in FIG. 3. In one preferred embodiment, the electronic controller 62 can be operated remotely using radio frequency (RF) signaling. The electronic controller 62 includes an RF receiver 116 which responds to coded RF signals transmitted by a transmitter 118 of the wireless remote control unit 38 to control adjustment of the snow plow blade 14. Adjustment of the snow plow blade using the wireless remote control unit 38 allows the operator to be located anywhere within the receiving range of the RF receiver 116 and the operator is not required to be in the cab 30 of the skid steer loader when adjustment is made. Although the RF remote control 38 is shown in the cab 30 of the skid-steer loader, the wireless remote control unit 38 is a portable unit and can be used anywhere within the receiving range of the RF receiver 116. In another embodiment, the control unit is connected directly to the receiver by a cable or separate wires. In such embodiment, the hard-wired control unit preferably can be located in the cab 30 of the skid steer loader. However, the hard-wired control unit can be located in any convenient location on the skid steer loader or on the plow unit.

Referring to FIGS. 6 and 18, the RF receiver 116 detects and decodes the coded RF signals transmitted by the transmitter 118 and provides drive signals for the valve coils, including the coil 89 of the direction control valve 86, the coils 95 and 96 of the left wing blade extend and retract valves 91 and 92, and the coils 97 and 98 of the right wing blade extend and retract valves 93 and 94. The outputs of the RF receiver 116 can be distributed to the valve coils by a connector assembly 119.

The RF receiver 116 can obtain operating power from the battery 15. In one embodiment, the battery 15 is a twelve volt, lead cell battery. However, other types of batteries, and batteries having other voltage ratings can be used provided the voltage/amperage operating requirements of the coils are met.

Referring to FIGS. 5 and 18, in one embodiment, the remote control unit 38 is a portable, battery-operated unit that includes a microcontroller 117, an on-off-keyed (OOK) RF transmitter 118 and a switch pad 130 including a plurality of controls, such as function select switches 131–134 and an on/off switch 135. The on/off switch 135 provides for on and off control and the function select switches provide for changing the angle of the left and right wing blades 18 and 20 of the snow plow blade. The on/off switch 135 activates the transmitter 118 of the remote control unit 38. The function select switches include separate forward (extend) and backward (retract) switches 131 and 132 for the left wing blade 18 and separate forward (extend) and backward (retract) switches 133 and 134 for the right wing blade 20.

In one embodiment, the RF wireless control employs frequency-shift-keying (FSK) with a pulse-width modulated data overlay to provide an integral timing reference and to provide some immunity to noise. The data packet structure includes a preamble, and a data portion including an address portion and a control data portion. The preamble allows synchronization of the RF receiver 116 with the RF transmitter 118 prior to the transmission of data. In one embodiment, the address portion and the control data portion each includes a sixteen bit word. The bits are encoded using pulse width modulation to allow bit timing to be established for the leading edge of the pulse.

In order to conserve battery power, the microcontroller 117 normally is maintained in a low power idle mode and is switched to an active or operating mode when one of the switches is operated. The microcontroller 117 provides a timing function for returning the microcontroller to the low power mode at the end of a time interval of inactivity as is known. At the start of an operating cycle, the microcontroller is activated by operating the on/off switch 135. The duration of the operating cycle is extended with each switch operation if one of the switches 131–134 is operated before the end of the time out period. When the microcontroller is awakened, the microcontroller scans all the switches 131–135 for all switch closures. Closure of a single switch causes movement of one of the wing blades. For example, actuating switch 131 causes the left wing blade 18 to be extended and actuating switch 132 causes the left wing blade to be retracted. Actuating switch 133 causes the right wing blade 20 extended and actuating switch 134 causes the right wing blade to be retracted. Multiple switch closures are possible to simultaneously extend and/or retract both of the wing blades. For example, actuating both switches 131 and 133 at the same time (by depressing the ends of the switches near the upper end of the controller) causes both the left and right wing blades to be extended. Actuating both switches 132 and 134 at the same time (by depressing the ends of the switches near the upper end of the controller) causes both the left and right wing blades to be retracted. Actuating both switches 131 and 134 at the same time, for example, causes the left wing blade to be extended and the right wing blade to be retracted. After all of the switches have been scanned, the data is placed into the control word with one bit corresponding to each key location. The control word is used to control the transmitter 118 to produce a unique FSK coded signal for each "set" of switch operations.

In addition, the RF receiver 116 normally is maintained in a low power idle mode and is activated in response to an RF coded signal transmitted to the RF receiver 116 by the transmitter 118. The RF receiver 116 can include a timer for returning the RF receiver to the low power idle mode at the end of a time interval of inactivity.

The transmitter 118 produces a different coded signal for each function to be provided and the RF receiver 116 detects which coded signal is being transmitted and produces the appropriate drive signals for the valve coils 95–98. In addition, the RF signal produced by the transmitter 118 in response to operating any of the switches 131–134 and transmitted to the receiver 116 causes the energization of valve coil 89, for operating the direction control valve 86.

Figure 19:
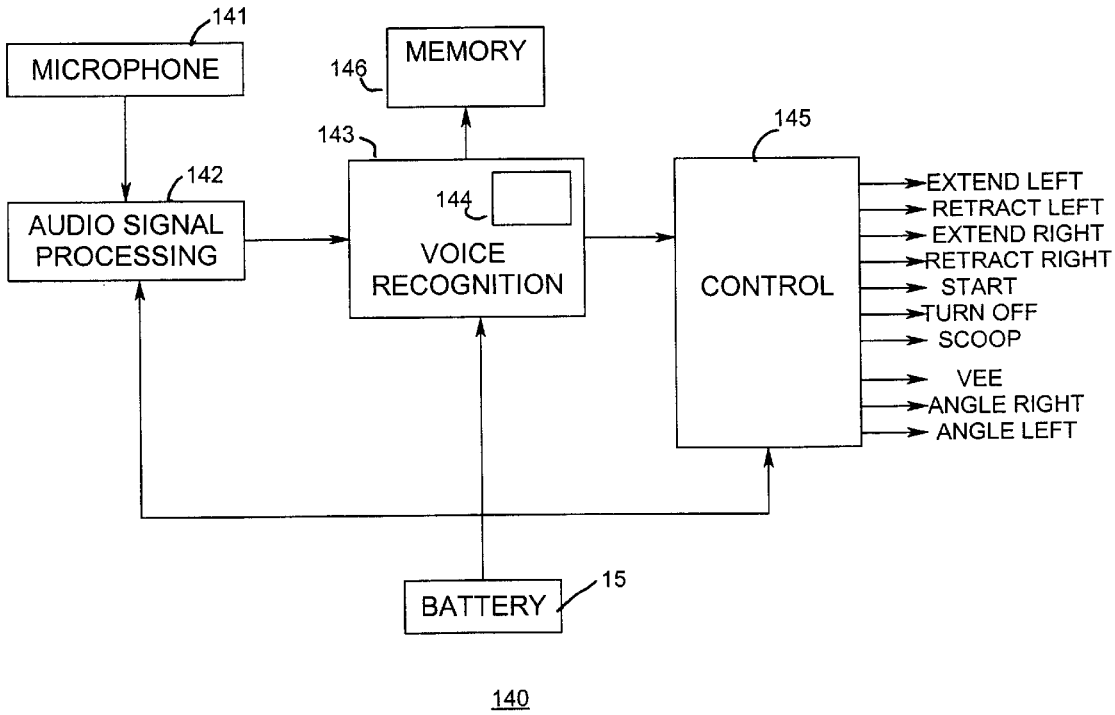
FIG. 19 is a block diagram of a voice-actuated controller for a plow system in accordance with a second embodiment of the invention.

Referring to FIG. 19, in accordance with a further embodiment, the repositioning of the left and right wing blades 18,20 of the plow blade 14 is controlled by a voice-actuated electronic controller 140 which responds to verbal commands spoken by an authorized user. The authorized user typically is the operator of the plow. However a number, of persons may be authorized to provide verbal commands, the voice-actuated controller 140 being conditioned to recognize the verbal commands provided by each authorized user, as is known. The controller 140 can be mounted on the snow plow 10 as shown in FIG. 3. This allows the operator to be located anywhere within the receiving range of the controller 140 and the operator is not required to be in the cab 30 of the skid steer loader when making adjustment in the position of the wing blades 18 and 20.

TABLE I

| Verbal Commands | |
|---|---|
| OPERATION | COMPONENT |
| Extend | Left Blade |
| Retract | Left Blade |
| Extend | Right Blade |
| Retract | Right Blade |
| Extend | Both Blades |
| Retract | Both Blades |
| Start | — |
| Stop | — |
| Turn Off | |
| Scoop | |
| Vee | |
| Angle Right | |
| Angle Left | |

The verbal commands can be divided into two portions, one portion indicating an operation, such as "Extend", being called for and the other portion indicating which component, such as "Left Blade", is to be moved. The verbal commands are summarized in TABLE I. The "Start" command is used to "wake-up" the controller, enabling the voice-actuated electronic controller 140 to receive verbal commands. The "Stop" command is used to end the adjustment of a wing blade currently being adjusted. The left and right wing blades can be adjusted simultaneously by issuing a command such as, "Both Blades", Scoop (both blades forward), Vee (both blades back), Angle Right and Angle Left. The "Turn Off" command returns the controller to low power.

The audio signal processing circuit 142 amplifies and filters the audio signal and converts the audio signal into a digital signal. The resultant digital signal is supplied to the voice recognition circuit 143.

The voice recognition circuit 143 includes a microprocessor 144 that processes digital signals produced by the audio signal processing circuit 142 and provides suitable signals for the control circuit 145. Speech patterns of the received audio signal (i.e., the verbal command) are compared with speech patterns stored in a memory 146, and if a match is detected, the function indicated by the verbal command is performed. A timer monitors the time between verbal commands received so that if more than one verbal command is presented within a predetermined time interval, only the first received command is acted upon.

The control circuit 145 provides drive signals for the valve coils, including the coil 89 of the direction control valve 86, the coils 95 and 96 of the left wing blade extend and retract valves 91 and 92, and the coils 97 and 98 of the right wing blade extend and retract valves 93 and 94. The outputs of the controller 140 can be distributed to the valve coils by a connector assembly 119. The controller 62 can obtain operating power from the battery 15.

The controller 140 normally is maintained in a low power idle mode and is activated in response to a voice command transmitted to the controller by the operator. The controller 140 can include a timer for returning the controller 140 to the low power idle mode at the end of a time interval of inactivity.

In another embodiment, the microphone and the voice processing circuitry are built into a portable hand held unit similar to the remote control unit 38. In this embodiment, the voice processing circuits are similar to those. However, the outputs control an RF transmitter in the way the switches 131–134 control the transmitter 118 of the remote control unit 38 (FIG. 6). In such embodiment, the receiver can be the same as receiver 116 to respond to coded RF signals and cause activation of appropriate solenoid coils. It is apparent that the control unit can include the buttons allowing the system to be manually controlled or voice activated.

Figure 8:
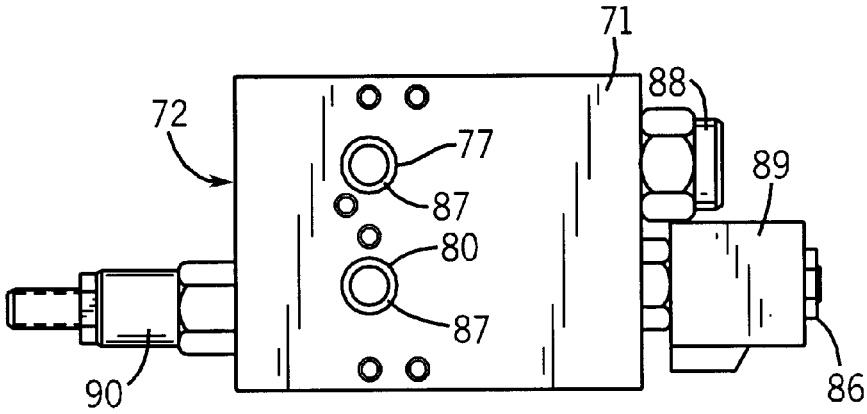
FIG. 8 is a top plan of a bottom valve block of a pressure head of the plow system.
Figure 9:
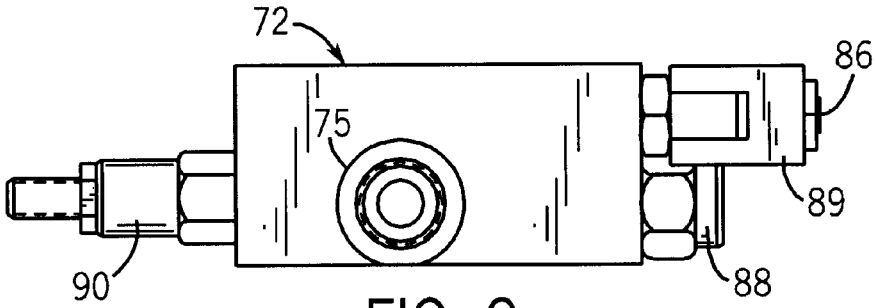
FIG. 9 is a front elevation view of the bottom valve block of the pressure head of FIG. 8.
Figure 10:
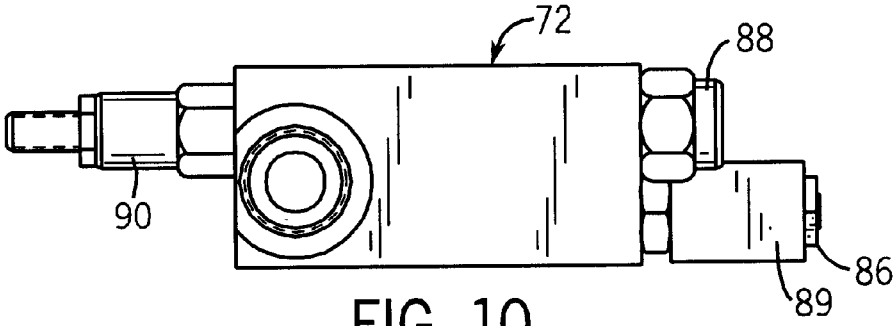
FIG. 10 is a rear elevation view of the bottom valve block of the pressure head of FIG. 8.
Figure 11:
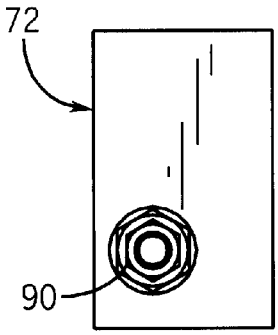
FIG. 11 is a left side elevation view of the bottom valve block of the pressure head of FIG. 8.
Figure 12:
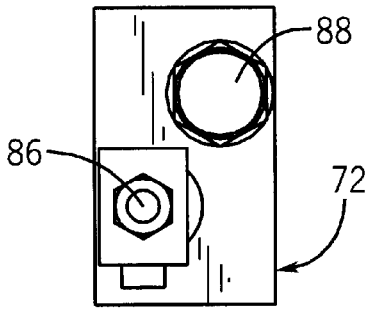
FIG. 12 is a right side elevation view of the bottom valve block of the pressure head of FIG. 8.
Figure 13:
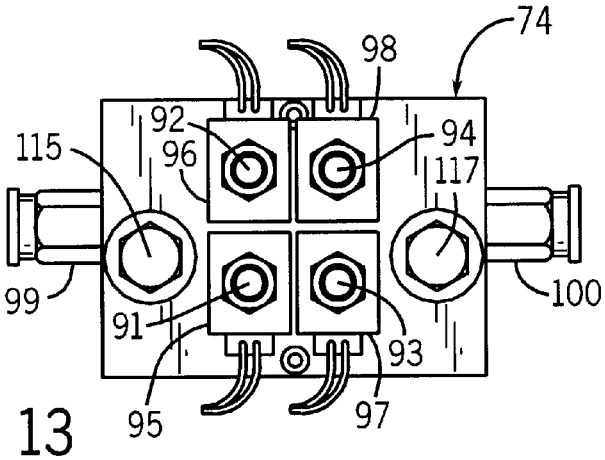
FIG. 13 is a top plan view of a top valve block of the pressure head of the plow system.
Figure 14:
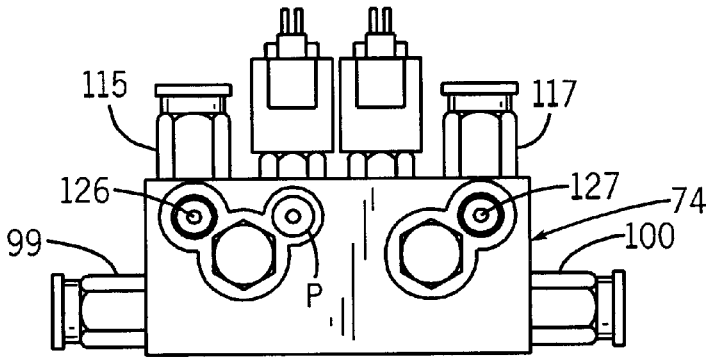
FIG. 14 is a front elevation view of the top valve block of the pressure head of the plow system.
Figure 20:
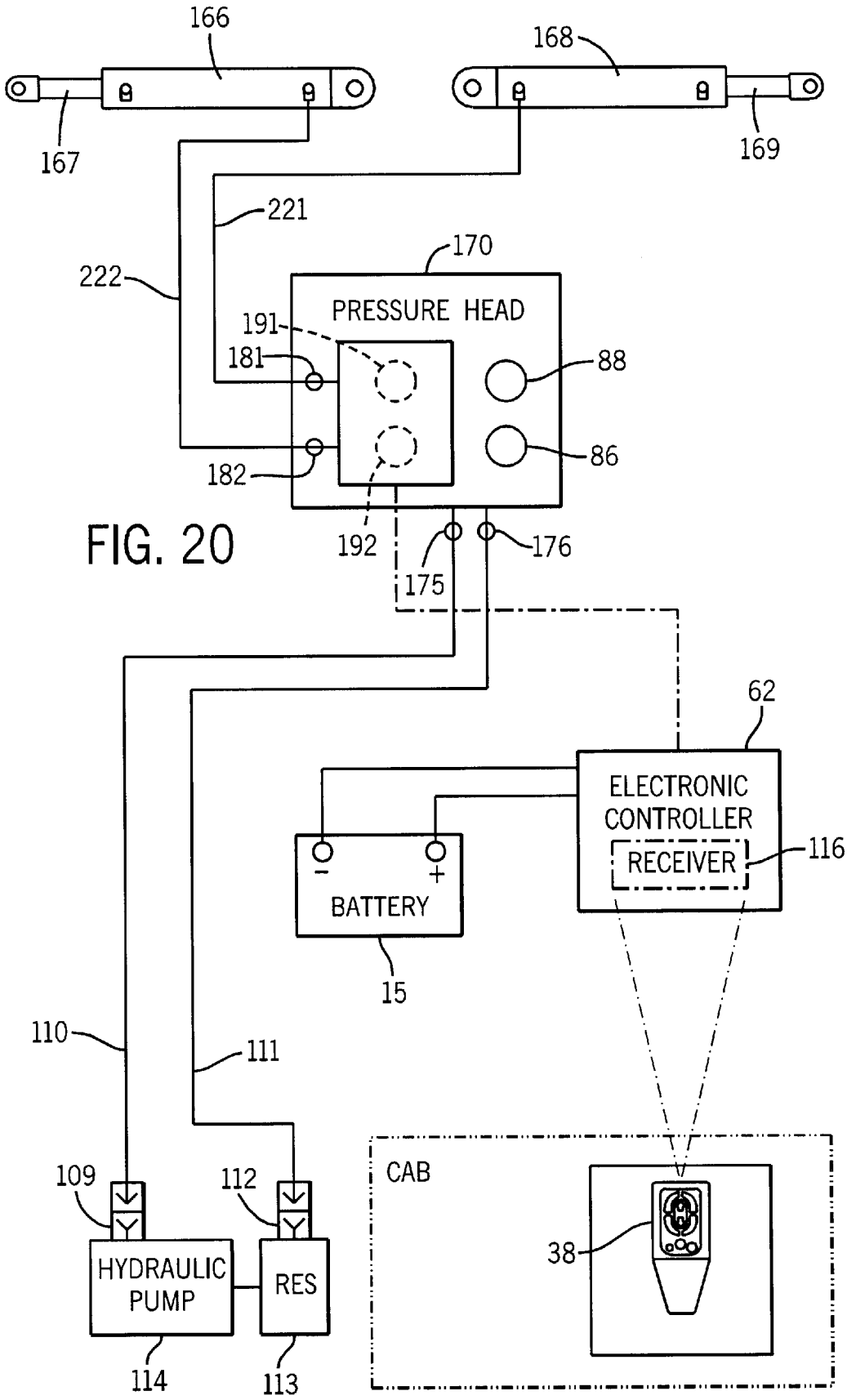
FIG. 20 is a block diagram of electrical and hydraulic components of the plow system in accordance with a second embodiment of the invention.
Figure 21:
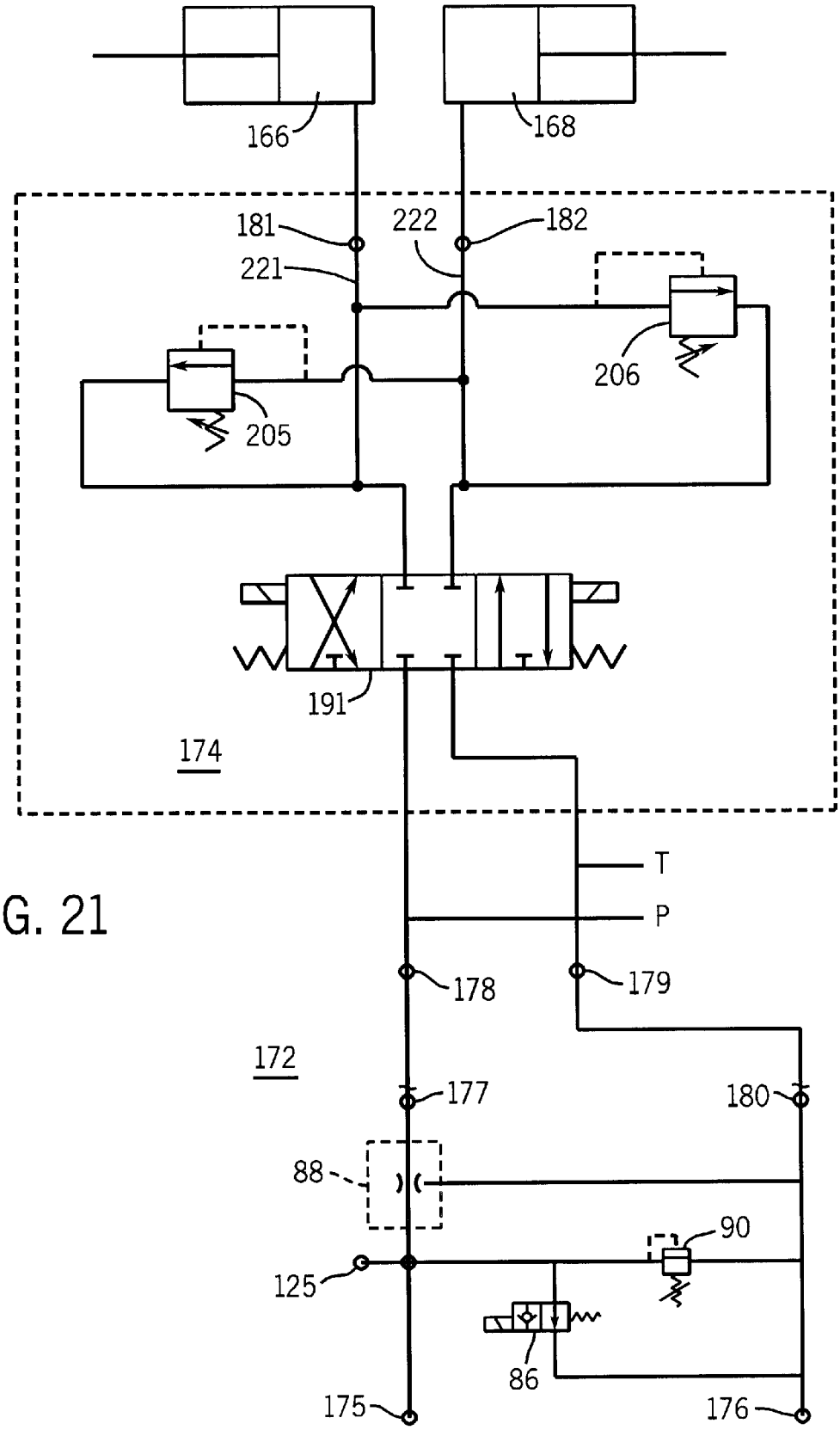
FIG. 21 is a schematic diagram of the hydraulic components of the plow system of FIG. 20.
Figure 22:
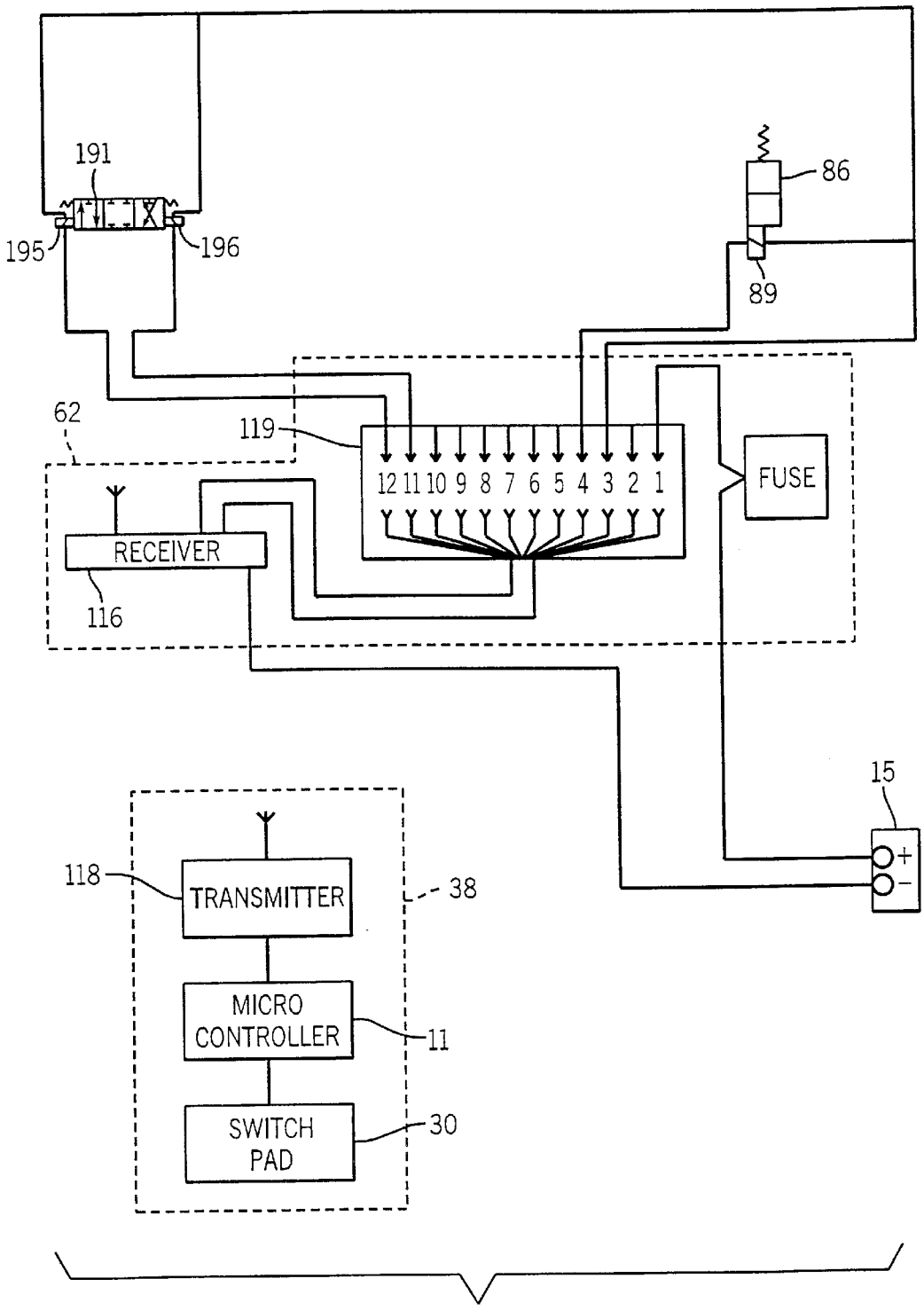
FIG. 22 is a schematic diagram of electrical components of the plow system of FIG. 20

Referring to FIGS. 20, 21 and 22, in accordance with another embodiment of the invention, a plow system includes a pressure head 170 for a straight plow blade controls left and right single actuators 166 and 168 for left and right repositioning of the straight plow blade. The pressure head 170 includes a bottom valve block 172 and a top valve block 174 which are similar to the bottom valve block 72 and top valve block 74 of pressure head 70 (FIGS. 6 and 8). However, the top valve block 174 includes a four way, three position valve 191 that provides the extend and retract functions. However, the top valve block 174 can include separate extend and retract valves operating in the manner of wing blade extend and retract valves 91 and 92 of pressure head 70 shown in FIGS. 6 and 7. The bottom valve block 172 can be the same as bottom valve block 72, and include a direction valve 86, a flow controller 88 and a pressure relief valve 90.

This embodiment provides a central hydraulics package for controlling a plow unit that is mounted on a truck or other vehicle, other than a skid steer loader. The pressure head 170, which is mounted on the plow unit provides distribution of hydraulic fluid to hydraulic components of the plow system such that only two hydraulic hoses are required to connect to the pressure head 170 to the hydraulic system of the vehicle. Although only left and right adjustment of the angle of a straight plow blade is described, the hydraulic control system can provide vertical lift and downpressure functions by including additional actuators connected to receive hydraulic fluid under pressure from further outlets of the pressure head 170, in the manner that separate extend/retract functions are provided for a V-plow by the pressure head 70 described above with reference to FIGS. 1–17. In contrast, known hydraulically operated plow control systems that use the hydraulic system of a truck or other vehicle for supplying hydraulic fluid for the plow, require up to four hydraulic hoses to provide left and right positioning of the plow blade, in addition to lift and down pressure functions. The truck unit mounted plow system can employ wireless RF control and/or voice-actuated mechanisms for controlling the positioning of the plow blade.

The plow control system illustrated in FIGS. 20–22 can be operated using wireless, remote RF control, including an electronic controller 162 and a remote control unit 138. The operation of the plow control system illustrated in FIGS. 20–22 is similar to that described above except that only extend commands are required, the blade being angled to the left (or returned to the "straight" position from a right angle) when an angle left command is provided and the blade being angled to the right (or returned from to the "straight" position from a left angle position) when an angle right command is provided. The remote control unit 138 can include only two function select switches to provide left and right extend commands, an and on/off switch. Alternatively, the plow control system illustrated in FIGS. 20–22 can be a voice-actuated system.

Operation

Referring to FIGS. 1, 3 and 6, the snow plow 10 is mounted on the skid-steer loader 12 and pressure inlet port 75 and return outlet port 76 of the hydraulic system of the snow plow are connected to the pressure outlet 109 and the hydraulic fluid return inlet 112, respectively, of the auxiliary hydraulic fluid outlet of the skid-steer loader 12 by hydraulic lines 110 and 111.

To operate the snow plow 10, the operator can enter the cab 30 of the skid-steer loader 12 through a door located on the front of the skid-steer loader, using the upper edge 50 for footing whenever entering or exiting the cab 30. Although the RF wireless remote control 38 is shown in the cab 30 of the skid-steer loader, the wireless remote control unit 38 is a portable unit and can be used anywhere within the receiving range of the RF receiver 116. Thus, the operator can adjust the angle of the wing blades 18 and 20 from either inside or outside of the cab using the remote control unit 38. This could be used in remote controlled skid steer loader applications, such as for unmanned skid steer loaders.

Figure 4H:
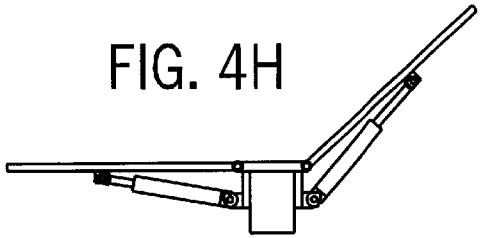
FIGS. 4A–4I are simplified representations of the left and right wing blades of the plow system shown in different positions.
Figure 4G:
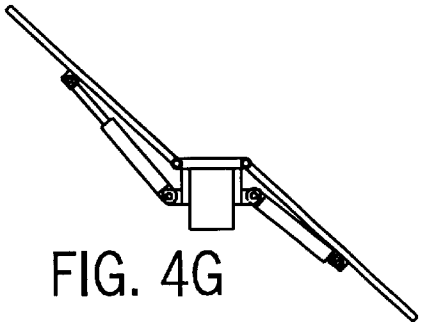
Figure 4I:
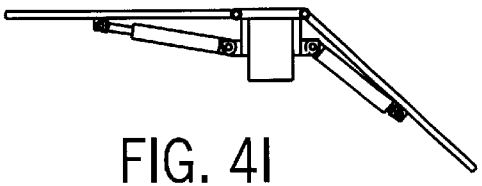
Figure 4B:
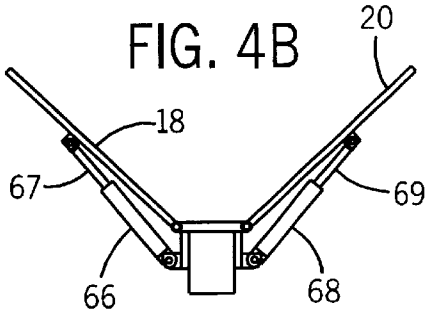
Figure 4A:
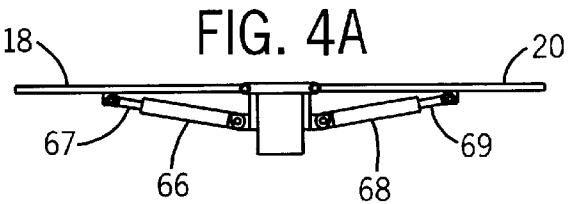
Figure 4C:
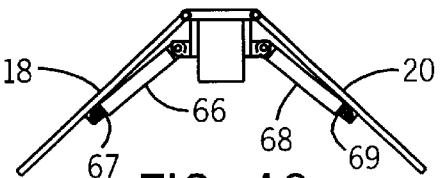
Figure 4E:
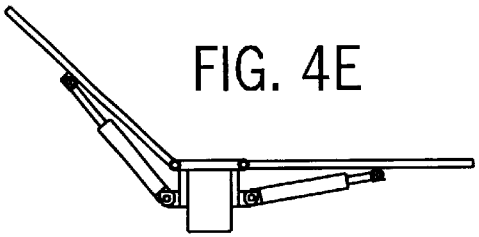
Figure 4D:
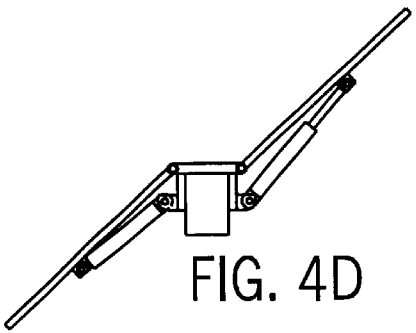
Figure 4F:
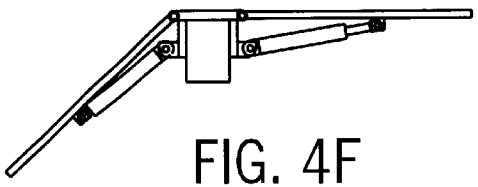

For purposes of describing the operation of the snow plow, it is assumed that the wing blades 18 and 20 initially are oriented straight forwardly as illustrated in FIGS. 3 and 4A. The auxiliary hydraulic output can be maintained in the on condition while the skid-steer loader 12 is being operated. The bottom valve block 72 enables the pressurized hydraulic fluid supplied to the hydraulic system of the snow plow to be diverted away from the top valve block 74 and circulated back to the reservoir 113 of the skid-steer loader because the normally open direction control valve 86 is deenergized unless an adjustment is being made in the orientation of the wing blades.

Referring also to FIG. 5, to reposition the wing blades 18 and 20 forwardly to the positions illustrated in FIG. 4B, for example, the operator depresses the on/off switch 135 to activate the microcontroller 118 that controls the RF transmitter 118 to transmit an activate signal for activating the RF receiver 116. Then, the operator causes the appropriate valves, the left and right wing blade extend valves 91 and 93 in the example, to be operated to the condition in which the left and right wing blade extend valves 91 and 93 communicate the hydraulic pressure line 110 with the hydraulic actuators. To operate the left and right wing blade extend valves 91 and 93, the operator uses the remote control unit 38, depressing switches 131 and, 133 simultaneously which causes a coded RF signal to be produced by the transmitter 118 and transmitted to the receiver 116 to cause the energization of coils 95 and 97 of the left and right wing blade extend valves 91 and 93. An RF signal is produced simultaneously by the transmitter 118 and transmitted to the receiver 116 to cause the energization of the valve solenoid 89 operating the direction control valve 86. The receiver 116 detects and decodes the coded RF signal and produces drive signals which are applied to the coils 95 and 97 for operating the left and right wing blade extend valves 91 and 93 to the condition in which the pressurized hydraulic fluid line 110 is communicated through extend lines 121 and 123 to the hydraulic actuators. The receiver 116 also produces a drive signal for the coil 89 for operating the direction control valve 86 to its open condition, allowing hydraulic fluid to be supplied to the wing blade extend valves 91 and 93. It is pointed out that whenever one or more of the switches 131, 132, 133 or 134 is actuated, the RF signal transmitted by the transmitter 118 to the receiver 116 to cause the energization of the coils 95, 96, 97 or 98 also causes the energization of valve coil 89 for the operation of valve 86. In the embodiment that includes the voice actuated controller 140 (FIG. 19), the operator speaks the command "Extend Both".

The hydraulic fluid supplied to the hydraulic actuators when the left and right wing blade extend valves 91 and,93 are operated drives the piston rods 67 and 69 to their extended positions, changing the angle of the wing blades 18 and 20 of the plow blade 14 to the orientation illustrated in FIG. 4B. If for any reason it is necessary to raise or lower the plow blade, the plow blade 14 can be raised and lowered by raising and lowering the tool carrier plate 22 of the skid-steer loader from within the cab 30. The operator maintains the switches 131 and 133 operated until the desired orientation is reached for the wing blades 18 and 20.

When the operator releases the switches, the left and right wing blade extend valves 91 and 93 are closed to prevent further pressurized hydraulic fluid from being supplied to the hydraulic actuators, and the wing blades 18 and 20 are maintained by the check valves 101 and 103 in the position to which they have been driven. In addition, the direction control valve 86 is opened, again diverting hydraulic fluid away from the top valve block 74 and circulating the pressurized hydraulic fluid back to the reservoir 113. As is stated above, this function enables the auxiliary hydraulic output of the skid-steer loader to be maintained actuated or "on" even when no adjustment is being made in the orientation of the wing blades 18 and 20.

The double acting hydraulic actuators operate the left and right wing blades 18 and 20 which are adjustable to "V", and "scoop" configurations and all positions in between, as shown for example, in FIGS. 4A–4I. Trip action is provided from "V" (or scoop) to straight positions. Under an overload condition for either or both of the wing blades 18 and 20, the corresponding direct acting wing relief valve 99 and/or 100 operates if the hydraulic pressure becomes equal to or exceeds 2100 psi. This causes the hydraulic fluid in the associated hydraulic cylinder 66 and 68 to be dumped into the reservoir 113, through the wing relief valve 99 and/or 100 that has been operated, enabling the wing blade 18 and/or 20 to be moved towards the straight line position illustrated in FIG. 4A where the plow will mechanically trip. If the hydraulic pressure in hydraulic cylinder 66 (and/or 68) increases to a value that is equal to or greater than 2100 psi, such that one or both of the crossover valves 105 and 106 (and/or 107 and 108) operates, the wing relief valve 99 (and/or 100) is communicated with the high pressure either directly or through the operated crossover valve(s) allowing the wing relief valves to operate if the pressure increases further to become equal to or exceed 2100 psi.

To return the blade wings 18 and 20 to a straight position, the switches 132 and 134 on remote controller 38 are actuated (or the appropriate verbal command is given) to retract the blades 18 and 20 to the straight position. When switches 132 and 134 are operated, the coded RF signals transmitted cause control valve 86 to close, allowing hydraulic fluid to be directed to the top valve block 74. In addition, the left and right wing blade retract valves 92 and 94 are operated, to supply pressurized hydraulic fluid to the rod sides of the hydraulic actuators 66 and 68 to retract the cylinder pistons 66 and 68, causing the blade wings to be retracted. In addition, as hydraulic fluid begins to flow through the left and right wing blade retract valves 92 and 94, the check valves 101 and 103 are operated open. This provides a fluid flow path through the check valves 101 and 103 and the left and right wing blade extend valves 91 and 93 to the return line 111 for the hydraulic fluid previously introduced into the piston cylinders 66 and 68 to cause the piston rods to be retracted. It is apparent that rather than returning the wing blades to the straight position, the position of only one of wing blades can be adjusted, or one of the wing blades can be extended further forwardly while the other wing blade is retracted by operating the appropriate one of switches 131–134. The hydraulic fluid flow is diverted from the bypass condition to the condition of supplying the hydraulic valves and actuators simultaneously with the activation of any hydraulic valve and reverting to the bypass condition simultaneously with the deactivation of any hydraulic valve, this occurring without the need for any separate or independent switching.

The operation of the plow control system illustrated in FIGS. 20–22 is similar to that described above except that only extend commands are required, the blade being angled to the left (or returned to the "straight" position from a right angle) when an angle left command is provided and the blade being angled to the right (or returned from to the "straight" position from a left angle position) when an angle right command is provided. The remote control unit 38 can include only two function select switches to provide left and right extend commands, an and on/off switch. The control for the straight blade can be voice-actuated, responding to verbal commands such as angle left, angle right, shut down, and etc.

While preferred embodiments have been illustrated and described, it should be understood that changes and modifications can be made thereto without departing from the invention in its broadest aspects. Various features of the invention are defined in the following claims.

What is claimed is:

1. A plow system for use with a vehicle, the vehicle having a hydraulic system for supplying hydraulic fluid under pressure from a hydraulic fluid reservoir to a hydraulic fluid outlet, wherein the hydraulic system is operable in an active mode to continuously supply hydraulic fluid under pressure to the hydraulic fluid outlet, said plow system comprising:

a repositionable plow blade;

a hydraulic actuator coupled to the plow blade;

a hydraulic control system including a pressure head for supplying hydraulic fluid from the hydraulic fluid outlet to the hydraulic actuator to enable the hydraulic actuator to reposition the plow blade; and a bypass device for diverting hydraulic fluid away from the hydraulic actuator when the hydraulic system is operating in the active mode and the plow blade is not being repositioned, the bypass device including a valve wherein the valve is a normally open valve interposed between a hydraulic fluid inlet port and a hydraulic fluid outlet port of the pressure head.

2. The plow system according to claim 1, wherein the, hydraulic control system includes a pressure relief valve interposed between the hydraulic fluid inlet port and the hydraulic fluid outlet port for diverting hydraulic fluid to the hydraulic fluid reservoir in response to an overpressure condition.

3. A plow system for use with a vehicle, the vehicle having a hydraulic system for supplying hydraulic fluid under pressure from a hydraulic fluid reservoir to a hydraulic fluid outlet, wherein the hydraulic system is operable in an active mode to continuously supply hydraulic fluid under pressure to the hydraulic fluid outlet, said plow system comprising:

a repositionable plow blade;

a hydraulic actuator coupled to the plow blade;

a hydraulic control system including a pressure head for supplying hydraulic fluid from the hydraulic fluid outlet to the hydraulic actuator to enable the hydraulic actuator to reposition the plow blade, wherein the hydraulic control system includes a four-way valve operable in a first mode to supply hydraulic fluid to the hydraulic actuator for extending a rod of the hydraulic actuator and operable in a second mode to supply hydraulic fluid to the hydraulic actuator for retracting the rod of the hydraulic actuator; and a bypass device for diverting hydraulic fluid away from the hydraulic actuator when the hydraulic system is operating in the active mode and the plow blade is not being repositioned.

4. A plow system for use with a vehicle, the vehicle having a hydraulic system for supplying hydraulic fluid under pressure from a hydraulic fluid reservoir to a hydraulic fluid outlet, wherein the hydraulic system is operable in an active mode to continuously supply hydraulic fluid under pressure to the hydraulic fluid outlet, said plow system comprising:

a repositionable plow blade;

a hydraulic actuator coupled to the plow blade;

a hydraulic control system including a pressure head for supplying hydraulic fluid from the hydraulic fluid outlet to the hydraulic actuator to enable the hydraulic actuator to reposition the plow blade;

a bypass device for diverting hydraulic fluid away from the hydraulic actuator when the hydraulic system is operating in the active mode and the plow blade is not being repositioned; and a wireless remote control transmitter which transmits coded radio frequency signals, and a wireless remote control receiver which receives the coded radio frequency signals and, in response to said coded frequency signals, provides an activating signal for causing the bypass device to allow hydraulic fluid to be supplied to the hydraulic actuator.

5. The plow system of claim 4, wherein the plow blade comprises a V-plow blade that includes first and second wing blades, and including a separate hydraulic actuator for each wing blade, and wherein the transmitter includes controls for selectively repositioning the first and second wing blades.

6. The plow system according to claim 5, wherein the transmitter comprises a self-contained, battery-powered portable device locatable within a cab of the vehicle or at a location outside of the cab of the vehicle.

7. The plow system according to claim 5, wherein the hydraulic control system includes a pressure relief valve operable to cause hydraulic fluid to be returned to the hydraulic fluid reservoir in response to an overload condition on one of the wing blades.

8. A plow system for use with a vehicle, the vehicle having a hydraulic system for supplying hydraulic fluid under pressure from a hydraulic fluid reservoir to a hydraulic fluid outlet, wherein the hydraulic system is operable in an active mode to continuously supply hydraulic fluid under pressure to the hydraulic fluid outlet, said plow system comprising:

a repositionable plow blade;

a hydraulic actuator coupled to the plow blade;

a hydraulic control system including a pressure head for supplying hydraulic fluid from the hydraulic fluid outlet to the hydraulic actuator to enable the hydraulic actuator to reposition the plow blade;

a bypass device for diverting hydraulic fluid away from the hydraulic actuator when the hydraulic system is operating in the active mode and the plow blade is not being repositioned; and a voice-actuated controller which is responsive to voice commands provided by an operator of the plow system to provide an activating signal for causing the bypass device to allow hydraulic fluid to be supplied to the hydraulic actuator for repositioning the plow blade.

9. A plow system for use with a vehicle, the vehicle having a hydraulic system for supplying hydraulic fluid under pressure from a hydraulic fluid reservoir to a hydraulic fluid outlet, wherein the hydraulic system is operable in an active mode to continuously supply hydraulic fluid under pressure to the hydraulic fluid outlet, said plow system comprising:

a repositionable plow blade;

a hydraulic actuator coupled to the plow blade;

a hydraulic control system including a pressure head for supplying hydraulic fluid from the hydraulic fluid outlet to the hydraulic actuator to enable the hydraulic actuator to reposition the plow blade, the pressure head having a fluid inlet connected by a hydraulic pressure hose line to a fluid outlet of the hydraulic system of the vehicle and a fluid outlet connected by a hydraulic return hose line to a reservoir of the hydraulic system of the vehicle; and a bypass device for diverting hydraulic fluid away from the hydraulic actuator to said hydraulic return line when the hydraulic system is operating in the active mode and the plow blade is not being repositioned, the bypass device including a valve, wherein the valve is a normally open valve interposed between a hydraulic fluid inlet port and a hydraulic fluid outlet port of the pressure head.

10. A plow system for use with a vehicle, the vehicle having a hydraulic system for supplying hydraulic fluid under pressure from a hydraulic fluid reservoir to a hydraulic fluid outlet, the hydraulic system being operable in an active mode to continuously supply hydraulic fluid under pressure to the hydraulic fluid outlet, said plow system comprising:

a repositionable V-plow blade;

hydraulic actuators coupled to the hydraulic V-plow blade for repositioning the V-plow blade;

a hydraulic control system including a pressure head for delivering hydraulic fluid from the hydraulic fluid outlet to the hydraulic actuators to enable the hydraulic actuators to reposition the V-plow blade, the pressure head defining a first fluid flow path for supplying hydraulic fluid under pressure to the hydraulic actuators for operating the hydraulic actuator to reposition the plow blade, and a second fluid flow path; and a bypass device for diverting hydraulic fluid away from the first fluid flow path and returning the hydraulic fluid to the reservoir when the hydraulic system is operating in the active mode and the V-plow blade is not being repositioned.

11. A plow system for use with a vehicle, the vehicle having a hydraulic system for supplying hydraulic fluid under pressure from a hydraulic fluid reservoir to a hydraulic fluid outlet, the hydraulic system being operable in an active mode to continuously supply hydraulic fluid under pressure to the hydraulic fluid outlet, said plow system comprising:

a V-plow blade including first and second wing blades which are independently repositionable;

a support structure supporting the first and second wing blades to enable repositioning of the first and second wing blades;

first and second hydraulic actuators for repositioning the first and second wing blades, respectively;

a hydraulic control system including a pressure head interposed between the fluid outlet and the hydraulic actuators for supplying hydraulic fluid to the hydraulic actuators to enable the hydraulic actuators to reposition the first and second wing blades; and a bypass device for diverting hydraulic fluid away from the hydraulic actuators and returning the hydraulic fluid to the reservoir when the hydraulic system is operating in the active mode and neither one of the wing blades is being repositioned.

12. The snow plow system according to claim 11, wherein the bypass device comprises a valve.

13. The plow system according to claim 11, and including a wireless remote control transmitter which transmits coded radio frequency signals, and a wireless remote control receiver which receives the coded radio frequency signals and, in response to said coded frequency signals, provides an activating signal for causing the bypass device to allow hydraulic fluid to be supplied to the hydraulic actuator.

14. The plow system of claim 13 wherein the transmitter comprises a self-contained, battery-powered portable device locatable within or outside of the cab of the vehicle.

15. The plow system of claim 13, wherein the transmitter includes controls for selectively repositioning the first and second wing blades.

16. The plow system according to claim 11, including a voice-actuated controller which is responsive to voice commands provided by an operator of the plow system to provide an activating signal for causing the bypass device to allow hydraulic fluid to be supplied to the hydraulic actuators for repositioning the first and second wing blades.

17. The snow plow system according to claim 11, wherein the hydraulic control system includes a first extend valve and a first retract valve individually operable to communicate to supply hydraulic fluid to the first hydraulic actuator for operating the first hydraulic actuator, and a second extend valve and a second retract valve individually operable to communicate to supply hydraulic fluid to the second hydraulic actuator for operating the second hydraulic actuator.

18. A snow plow system for use with a skid-steer loader, the skid steer loader having a hydraulic system including an auxiliary hydraulic output, the hydraulic system being operable in an active mode to continuously supply hydraulic fluid under pressure to the auxiliary hydraulic outlet, said snow plow system comprising:

a V-plow blade, a support structure supporting the V-plow blade, the V-plow blade including first and second wing blades that are repositionable;

first and second hydraulic actuators for repositioning the wing blades;

a control unit supported by the support structure, the control unit operating the first and second hydraulic actuators to reposition the first and second wing blades, respectively;

a hydraulic control unit including a pressure head interposed between the hydraulic fluid outlet and the hydraulic actuators, the pressure head including a first fluid flow path for supplying hydraulic fluid under pressure to the hydraulic actuators for operating the hydraulic actuators, and a second fluid flow path; and a bypass device for diverting hydraulic fluid away from the first fluid flow path and returning the hydraulic fluid to the reservoir when the hydraulic system is operating in the active mode and neither one of the wing blades is being repositioned.

19. The snow plow system according to claim 18, including a wireless remote control transmitter which transmits coded radio frequency signals, and a wireless remote control receiver which receives the coded radio frequency signals and in response to said coded frequency signals provides an activating signal for causing the bypass device to supply hydraulic fluid to the hydraulic actuators.

20. The snow plow system of claim 19, wherein the transmitter includes controls for selectively repositioning the first and second wing blades.

21. The snow plow system according to claim 20, wherein the transmitter comprises a self-contained, battery-powered portable device locatable within a cab of the vehicle or at a location outside of the cab of the vehicle.

22. The snow plow system according to claim 19, wherein the pressure head and the control unit are supported by the support structure.

23. The snow plow system according to claim 22, and including a battery for supplying electrical power to the control unit, and wherein the battery is supported by the support structure.

24. The snow plow system according to claim 18, wherein the bypass device comprises a valve.

25. The snow plow system according to claim 18, wherein the pressure head includes a first valve block and a second valve block mounted to the first valve block, the valve mounted on the first valve block, the second valve block including a first extend valve and a first retract valve for supplying hydraulic fluid to the first hydraulic actuator for operating the first hydraulic actuator and a second extend valve and a second retract valve for supplying hydraulic fluid to the second hydraulic actuator for operating the second hydraulic actuator.

26. A plow system for use with a skid-steer loader, access to and egress from a cab of the skid steer loader being through a doorway located at the front of the skid steer loader, said plow system comprising:

a plow blade; and a support structure supporting the plow blade to enable repositioning of the plow blade, the support structure including a vertically extending panel;

the upper edge of the panel located forward of the doorway, enabling an operator to use the upper edge of the panel for footing upon entering or exiting the cab, wherein the upper edge of the panel defines an anti-slip surface.

27. The plow system according to claim 26, wherein the upper edge of the panel includes patterned steel to provide said anti-slip surface.

28. The plow system according to claim 26, wherein the upper edge of the panel includes a layer of non-slip material to provide said anti-slip surface.

29. The plow system according to claim 26, wherein the vertically extending panel comprises an adapter plate which facilitates attachment of the plow system to the skid-steer loader.

30. A system for use with a vehicle, the vehicle having a hydraulic system for supplying hydraulic fluid under pressure from a hydraulic fluid reservoir to a hydraulic fluid outlet, wherein the hydraulic system is operable in an active mode to continuously supply hydraulic fluid under pressure to the hydraulic fluid outlet, said system comprising:

a repositionable hydraulic actuated device;

a hydraulic actuator coupled to the hydraulic actuated device;

a hydraulic control system including a pressure head for supplying hydraulic fluid from the hydraulic fluid outlet to the hydraulic actuator to enable the hydraulic actuator to reposition the hydraulic actuated device; and a bypass device for diverting hydraulic fluid away from the hydraulic actuator when the hydraulic system is operating in the active mode and the hydraulic actuated device is not being repositioned, the bypass device including a normally open valve interposed between a hydraulic fluid inlet port and a hydraulic fluid outlet port of the pressure head.

31. The system according to claim 30, wherein the hydraulic control system includes a pressure relief valve interposed between the hydraulic fluid inlet port and the hydraulic fluid outlet port for diverting hydraulic fluid to the hydraulic fluid reservoir in response to an overpressure condition.

32. A system for use with a vehicle, the vehicle having a hydraulic system for supplying hydraulic fluid under pressure from a hydraulic fluid reservoir to a hydraulic fluid outlet, wherein the hydraulic system is operable in an active mode to continuously supply hydraulic fluid under pressure to the hydraulic fluid outlet, said system comprising:

a repositionable hydraulic actuated device;

a hydraulic actuator coupled to the hydraulic actuated device;

a hydraulic control system including a pressure head for supplying hydraulic fluid from the hydraulic fluid outlet to the hydraulic actuator to enable the hydraulic actuator to reposition the hydraulic actuated device;

a bypass device for diverting hydraulic fluid away from the hydraulic actuator when the hydraulic system is operating in the active mode and the hydraulic actuated device is not being repositioned; and a wireless remote control transmitter which transmits coded radio frequency signals, and a wireless remote control receiver which receives the coded radio frequency signals and, in response to said coded frequency signals, provides an activating signal for causing the bypass device to allow hydraulic fluid to be supplied to the hydraulic actuator.

33. The system according to claim 32, wherein the transmitter includes controls for selectively repositioning the hydraulic actuated device.

34. The system according to claim 33, wherein the transmitter comprises a self-contained, battery-powered portable device locatable within a cab of the vehicle or at a location outside of the cab of the vehicle.

35. The system according to claim 33, wherein the hydraulic control system includes a pressure relief valve operable to cause hydraulic fluid to be returned to the hydraulic fluid reservoir in response to an overload condition on the hydraulic actuated device.

* * * * *